US007077890B2

(12) United States Patent
Botvinnik

(10) Patent No.: US 7,077,890 B2
(45) Date of Patent: Jul. 18, 2006

(54) ELECTROSTATIC PRECIPITATORS WITH INSULATED DRIVER ELECTRODES

(75) Inventor: Igor Y. Botvinnik, Novato, CA (US)

(73) Assignee: Sharper Image Corporation, San Francisco, CA (US)

( * ) Notice: Subject to any disclaimer, the term of this patent is extended or adjusted under 35 U.S.C. 154(b) by 35 days.

(21) Appl. No.: 10/774,579

(22) Filed: Feb. 9, 2004

(65) Prior Publication Data

US 2005/0051028 A1 Mar. 10, 2005

Related U.S. Application Data

(63) Continuation-in-part of application No. 10/717,420, filed on Nov. 19, 2003.

(60) Provisional application No. 60/500,437, filed on Sep. 5, 2003.

(51) Int. Cl.
*B03C 3/08* (2006.01)

(52) U.S. Cl. ..... 96/69; 96/79; 96/87; 96/88; 96/89; 422/186.04

(58) Field of Classification Search ..... 96/16, 96/69, 77–79, 86–88, 98–100; 95/59, 78–79; 422/186.04
See application file for complete search history.

(56) References Cited

U.S. PATENT DOCUMENTS

| | | | | |
|---|---|---|---|---|
| 653,421 | A | 7/1900 | Lorey | |
| 895,729 | A | 8/1908 | Carlborg | |
| 995,958 | A | 6/1911 | Goldberg | |
| 1,791,338 | A | 2/1931 | Wintermute | |
| 1,869,335 | A | 7/1932 | Day | |
| 1,882,949 | A | 10/1932 | Ruder | |
| 2,129,783 | A | 9/1938 | Penney | |
| 2,327,588 | A | 8/1943 | Bennett | |
| 2,359,057 | A | 9/1944 | Skinner | |
| 2,509,548 | A | 5/1950 | White | |
| 2,590,447 | A | 3/1952 | Nord et al. | |
| 2,949,550 | A | 8/1960 | Brown | |
| 2,978,066 | A * | 4/1961 | Nodolf | 96/87 |
| 3,018,394 | A | 1/1962 | Brown | |
| 3,026,964 | A | 3/1962 | Penney | |

(Continued)

FOREIGN PATENT DOCUMENTS

CN 87210843 U 7/1988

(Continued)

OTHER PUBLICATIONS

U.S. Appl. No. 10/278,193, filed Oct. 21, 2002, Reeves.

(Continued)

*Primary Examiner*—Richard L. Chiesa
(74) *Attorney, Agent, or Firm*—Bell, Boyd & Lloyd LLC

(57) ABSTRACT

Electrostatic precipitator (ESP) systems and methods are provided. A system includes at least one corona discharge electrode and at least one collector (and likely, at least a pair of collector electrodes) that extend downstream from the corona discharge electrode. An insulated driver electrode is located adjacent the collector electrode, and where there is at least a pair of collector electrodes, between each pair of collector electrodes. A high voltage source provides a voltage potential to the at least one of the corona discharge electrode and the collector electrode(s), to thereby provide a potential different therebetween. The insulated driver electrode(s) may or may not be at a same voltage potential as the corona discharge electrode, but should be at a different voltage potential than the collector electrode(s).

18 Claims, 20 Drawing Sheets

U.S. PATENT DOCUMENTS

| | | | | |
|---|---|---|---|---|
| 3,374,941 | A | | 3/1968 | Okress |
| 3,518,462 | A | | 6/1970 | Brown |
| 3,540,191 | A | | 11/1970 | Herman |
| 3,581,470 | A | | 6/1971 | Aitkenhead et al. |
| 3,638,058 | A | | 1/1972 | Fritzius |
| 3,744,216 | A | | 7/1973 | Halloran |
| 3,806,763 | A | | 4/1974 | Masuda |
| 3,892,927 | A | | 7/1975 | Lindenberg |
| 3,945,813 | A | | 3/1976 | Iinoya et al. |
| 3,958,960 | A | | 5/1976 | Bakke |
| 3,958,961 | A | | 5/1976 | Bakke |
| 3,958,962 | A | | 5/1976 | Hayashi |
| 3,981,695 | A | | 9/1976 | Fuchs |
| 3,984,215 | A | | 10/1976 | Zucker |
| 3,988,131 | A | | 10/1976 | Kanazawa et al. |
| 4,007,024 | A | | 2/1977 | Sallee et al. |
| 4,052,177 | A | | 10/1977 | Kide |
| 4,056,372 | A | | 11/1977 | Hayashi |
| 4,070,163 | A | | 1/1978 | Kolb et al. |
| 4,074,983 | A | | 2/1978 | Bakke |
| 4,092,134 | A | | 5/1978 | Kikuchi |
| 4,097,252 | A | | 6/1978 | Kirchhoff et al. |
| 4,102,654 | A | | 7/1978 | Pellin |
| 4,104,042 | A | | 8/1978 | Brozenick |
| 4,110,086 | A | | 8/1978 | Schwab et al. |
| 4,119,415 | A | | 10/1978 | Hayashi et al. |
| 4,126,434 | A | | 11/1978 | Keiichi |
| 4,138,233 | A | | 2/1979 | Masuda |
| 4,147,522 | A | | 4/1979 | Gonas et al. |
| 4,155,792 | A | | 5/1979 | Gelhaar et al. |
| 4,171,975 | A | | 10/1979 | Kato et al. |
| 4,185,971 | A | | 1/1980 | Isahaya |
| 4,189,308 | A | | 2/1980 | Feldman |
| 4,205,969 | A | | 6/1980 | Matsumoto |
| 4,209,306 | A | | 6/1980 | Feldman et al. |
| 4,218,225 | A | | 8/1980 | Kirchhoff et al. |
| 4,225,323 | A | | 9/1980 | Zarchy et al. |
| 4,227,894 | A | | 10/1980 | Proynoff |
| 4,231,766 | A | | 11/1980 | Spurgin |
| 4,232,355 | A | | 11/1980 | Finger et al. |
| 4,244,710 | A | | 1/1981 | Burger |
| 4,244,712 | A | | 1/1981 | Tongret |
| 4,251,234 | A | | 2/1981 | Chang |
| 4,253,852 | A | | 3/1981 | Adams |
| 4,259,093 | A | | 3/1981 | Vlastos et al. |
| 4,259,452 | A | | 3/1981 | Yukuta et al. |
| 4,259,707 | A | | 3/1981 | Penney |
| 4,264,343 | A | * | 4/1981 | Natarajan et al. ..... 96/48 |
| 4,266,948 | A | | 5/1981 | Teague et al. |
| 4,282,014 | A | | 8/1981 | Winkler et al. |
| 4,284,420 | A | | 8/1981 | Borysiak |
| 4,289,504 | A | | 9/1981 | Scholes |
| 4,293,319 | A | | 10/1981 | Claassen, Jr. |
| 4,308,036 | A | | 12/1981 | Zahedi et al. |
| 4,315,188 | A | | 2/1982 | Cerny et al. |
| 4,318,718 | A | | 3/1982 | Utsumi et al. |
| 4,338,560 | A | | 7/1982 | Lemley |
| 4,342,571 | A | | 8/1982 | Hayashi |
| 4,349,359 | A | | 9/1982 | Fitch et al. |
| 4,351,648 | A | | 9/1982 | Penney |
| 4,354,861 | A | | 10/1982 | Kalt |
| 4,357,150 | A | | 11/1982 | Masuda et al. |
| 4,362,632 | A | | 12/1982 | Jacob |
| 4,363,072 | A | | 12/1982 | Coggins |
| 4,366,525 | A | | 12/1982 | Baumgartner |
| 4,369,776 | A | | 1/1983 | Roberts |
| 4,375,364 | A | | 3/1983 | Van Hoesen et al. |
| 4,380,900 | A | | 4/1983 | Linder et al. |
| 4,386,395 | A | | 5/1983 | Francis, Jr. |
| 4,391,614 | A | | 7/1983 | Rozmus |
| 4,394,239 | A | | 7/1983 | Kitzelmann et al. |
| 4,405,342 | A | | 9/1983 | Bergman |
| 4,406,671 | A | | 9/1983 | Rozmus |
| 4,412,850 | A | | 11/1983 | Kurata et al. |
| 4,413,225 | A | | 11/1983 | Donig et al. |
| 4,414,603 | A | | 11/1983 | Masuda |
| 4,435,190 | A | | 3/1984 | Taillet et al. |
| 4,440,552 | A | | 4/1984 | Uchiya et al. |
| 4,443,234 | A | | 4/1984 | Carlsson |
| 4,445,911 | A | | 5/1984 | Lind |
| 4,477,263 | A | | 10/1984 | Shaver et al. |
| 4,477,268 | A | | 10/1984 | Kalt |
| 4,481,017 | A | | 11/1984 | Furlong |
| 4,496,375 | A | | 1/1985 | Le Vantine |
| 4,502,002 | A | | 2/1985 | Ando |
| 4,505,724 | A | | 3/1985 | Baab |
| 4,509,958 | A | | 4/1985 | Masuda et al. |
| 4,514,780 | A | | 4/1985 | Brussee et al. |
| 4,515,982 | A | | 5/1985 | Lechtken et al. |
| 4,516,991 | A | | 5/1985 | Kawashima |
| 4,521,229 | A | | 6/1985 | Baker et al. |
| 4,522,634 | A | | 6/1985 | Frank |
| 4,534,776 | A | | 8/1985 | Mammel et al. |
| 4,536,698 | A | | 8/1985 | Shevalenko et al. |
| 4,544,382 | A | | 10/1985 | Taillet et al. |
| 4,555,252 | A | | 11/1985 | Eckstein |
| 4,569,684 | A | | 2/1986 | Ibbott |
| 4,582,961 | A | | 4/1986 | Frederiksen |
| 4,587,475 | A | | 5/1986 | Finney, Jr. et al. |
| 4,588,423 | A | | 5/1986 | Gillingham et al. |
| 4,590,042 | A | | 5/1986 | Drage |
| 4,597,780 | A | | 7/1986 | Reif |
| 4,597,781 | A | | 7/1986 | Spector |
| 4,600,411 | A | | 7/1986 | Santamaria |
| 4,601,733 | A | | 7/1986 | Ordines et al. |
| 4,604,174 | A | | 8/1986 | Bollinger et al. |
| 4,614,573 | A | | 9/1986 | Masuda |
| 4,623,365 | A | | 11/1986 | Bergman |
| 4,626,261 | A | | 12/1986 | Jorgensen |
| 4,632,135 | A | | 12/1986 | Lenting et al. |
| 4,632,746 | A | | 12/1986 | Bergman |
| 4,636,981 | A | | 1/1987 | Ogura |
| 4,643,744 | A | | 2/1987 | Brooks |
| 4,643,745 | A | | 2/1987 | Sakakibara et al. |
| 4,647,836 | A | | 3/1987 | Olsen |
| 4,650,648 | A | | 3/1987 | Beer et al. |
| 4,656,010 | A | | 4/1987 | Leitzke et al. |
| 4,657,738 | A | | 4/1987 | Kanter et al. |
| 4,659,342 | A | | 4/1987 | Lind |
| 4,662,903 | A | | 5/1987 | Yanagawa |
| 4,666,474 | A | | 5/1987 | Cook |
| 4,668,479 | A | | 5/1987 | Manabe et al. |
| 4,670,026 | A | | 6/1987 | Hoenig |
| 4,674,003 | A | | 6/1987 | Zylka |
| 4,680,496 | A | | 7/1987 | Letournel et al. |
| 4,686,370 | A | | 8/1987 | Blach |
| 4,689,056 | A | | 8/1987 | Noguchi et al. |
| 4,691,829 | A | | 9/1987 | Auer |
| 4,692,174 | A | | 9/1987 | Gelfand et al. |
| 4,693,869 | A | | 9/1987 | Pfaff |
| 4,694,376 | A | | 9/1987 | Gesslauer |
| 4,702,752 | A | | 10/1987 | Yanagawa |
| 4,713,092 | A | | 12/1987 | Kikuchi et al. |
| 4,713,093 | A | | 12/1987 | Hansson |
| 4,713,724 | A | | 12/1987 | Voelkel |
| 4,715,870 | A | | 12/1987 | Masuda et al. |
| 4,725,289 | A | | 2/1988 | Quintilian |
| 4,726,812 | A | | 2/1988 | Hirth |
| 4,726,814 | A | | 2/1988 | Weitman |
| 4,736,127 | A | | 4/1988 | Jacobsen |
| 4,743,275 | A | | 5/1988 | Flanagan |
| 4,749,390 | A | | 6/1988 | Burnett et al. |
| 4,750,921 | A | | 6/1988 | Sugita et al. |
| 4,760,302 | A | | 7/1988 | Jacobsen |

4,760,303 A 7/1988 Miyake
4,765,802 A 8/1988 Gombos et al.
4,771,361 A 9/1988 Varga
4,772,297 A 9/1988 Anzai
4,779,182 A 10/1988 Mickal et al.
4,781,736 A 11/1988 Cheney et al.
4,786,844 A 11/1988 Farrell et al.
4,789,801 A 12/1988 Lee
4,808,200 A 2/1989 Dallhammer et al.
4,811,159 A 3/1989 Foster, Jr.
4,822,381 A 4/1989 Mosley et al.
4,853,005 A 8/1989 Jaisinghani et al.
4,869,736 A 9/1989 Ivester et al.
4,892,713 A 1/1990 Newman
4,929,139 A 5/1990 Vorreiter et al.
4,940,470 A 7/1990 Jaisinghani et al.
4,940,894 A 7/1990 Morters
4,941,068 A 7/1990 Hofmann
4,941,224 A 7/1990 Saeki et al.
4,944,778 A 7/1990 Yanagawa
4,954,320 A 9/1990 Birmingham et al.
4,955,991 A 9/1990 Torok et al.
4,966,666 A 10/1990 Waltonen
4,967,119 A 10/1990 Torok et al.
4,976,752 A 12/1990 Torok et al.
4,978,372 A 12/1990 Pick
D315,598 S 3/1991 Yamamoto et al.
5,003,774 A 4/1991 Leonard
5,006,761 A 4/1991 Torok et al.
5,010,869 A 4/1991 Lee
5,012,093 A 4/1991 Shimizu
5,012,094 A 4/1991 Hamade
5,012,159 A 4/1991 Torok et al.
5,022,979 A 6/1991 Hijikata et al.
5,024,685 A 6/1991 Torok et al.
5,030,254 A 7/1991 Heyen et al.
5,034,033 A 7/1991 Alsup, Jr. et al.
5,037,456 A 8/1991 Yu
5,045,095 A 9/1991 You
5,053,912 A 10/1991 Loreth et al.
5,059,219 A 10/1991 Plaks et al.
5,061,462 A 10/1991 Suzuki
5,066,313 A 11/1991 Mallory, Sr.
5,072,746 A 12/1991 Kantor
5,076,820 A 12/1991 Gurvitz
5,077,468 A 12/1991 Hamade
5,077,500 A 12/1991 Torok et al.
5,100,440 A 3/1992 Stahel et al.
RE33,927 E 5/1992 Fuzimura
D326,514 S 5/1992 Alsup et al.
5,118,942 A 6/1992 Hamade
5,125,936 A 6/1992 Johansson
5,136,461 A 8/1992 Zellweger
5,137,546 A 8/1992 Steinbacher et al.
5,141,529 A 8/1992 Oakley et al.
5,141,715 A 8/1992 Sackinger et al.
D329,284 S 9/1992 Patton
5,147,429 A 9/1992 Bartholomew et al.
5,154,733 A 10/1992 Fujii et al.
5,158,580 A 10/1992 Chang
D332,655 S 1/1993 Lytle et al.
5,180,404 A 1/1993 Loreth et al.
5,183,480 A 2/1993 Raterman et al.
5,196,171 A 3/1993 Peltier
5,198,003 A 3/1993 Haynes
5,199,257 A 4/1993 Colletta et al.
5,210,678 A 5/1993 Lain et al.
5,215,558 A 6/1993 Moon
5,217,504 A 6/1993 Johansson
5,217,511 A 6/1993 Plaks et al.
5,234,555 A 8/1993 Ibbott
5,248,324 A 9/1993 Hara
5,250,267 A 10/1993 Johnson et al.
5,254,155 A 10/1993 Mensi
5,266,004 A 11/1993 Tsumurai et al.
5,271,763 A 12/1993 Jang
5,282,891 A 2/1994 Durham
5,290,343 A 3/1994 Morita et al.
5,296,019 A 3/1994 Oakley et al.
5,302,190 A 4/1994 Williams
5,308,586 A 5/1994 Fritsche et al.
5,315,838 A 5/1994 Thompson
5,316,741 A 5/1994 Sewell et al.
5,330,559 A 7/1994 Cheney et al.
5,348,571 A 9/1994 Weber
5,376,168 A 12/1994 Inculet
5,378,978 A 1/1995 Gallo et al.
5,386,839 A 2/1995 Chen
5,395,430 A 3/1995 Lundgren et al.
5,401,301 A 3/1995 Schulmerich et al.
5,401,302 A 3/1995 Schulmerich et al.
5,403,383 A 4/1995 Jaisinghani
5,405,434 A 4/1995 Inculet
5,407,469 A 4/1995 Sun
5,407,639 A 4/1995 Watanabe et al.
5,417,936 A 5/1995 Suzuki et al.
5,419,953 A 5/1995 Chapman
5,433,772 A 7/1995 Sikora
5,435,817 A 7/1995 Davis et al.
5,435,978 A 7/1995 Yokomi
5,437,713 A 8/1995 Chang
5,437,843 A 8/1995 Kuan
5,445,798 A 8/1995 Ikeda et al.
5,466,279 A 11/1995 Hattori et al.
5,468,454 A 11/1995 Kim
5,474,599 A 12/1995 Cheney et al.
5,484,472 A 1/1996 Weinberg
5,484,473 A 1/1996 Bontempi
5,492,678 A 2/1996 Ota et al.
5,501,844 A 3/1996 Kasting, Jr. et al.
5,503,808 A 4/1996 Garbutt et al.
5,503,809 A 4/1996 Coate et al.
5,505,914 A 4/1996 Tona-Serra
5,508,008 A 4/1996 Wasser
5,514,345 A 5/1996 Garbutt et al.
5,516,493 A 5/1996 Bell et al.
5,518,531 A 5/1996 Joannu
5,520,887 A 5/1996 Shimizu et al.
5,525,310 A 6/1996 Decker et al.
5,529,613 A 6/1996 Yavnieli
5,529,760 A 6/1996 Burris
5,532,798 A 7/1996 Nakagami et al.
5,535,089 A 7/1996 Ford et al.
5,536,477 A 7/1996 Cha et al.
5,538,695 A 7/1996 Shinjo et al.
5,540,761 A 7/1996 Yamamoto
5,542,967 A 8/1996 Ponizovsky et al.
5,545,379 A 8/1996 Gray
5,545,380 A 8/1996 Gray
5,547,643 A 8/1996 Nomoto et al.
5,549,874 A 8/1996 Kamiya et al.
5,554,344 A 9/1996 Duarte
5,554,345 A 9/1996 Kitchenman
5,569,368 A 10/1996 Larsky et al.
5,569,437 A 10/1996 Stiehl et al.
D375,546 S 11/1996 Lee
5,571,483 A 11/1996 Pfingstl et al.
5,573,577 A 11/1996 Joannou
5,573,730 A 11/1996 Gillum
5,578,112 A 11/1996 Krause
5,578,280 A 11/1996 Kazi et al.
5,582,632 A 12/1996 Nohr et al.
5,587,131 A 12/1996 Malkin et al.
D377,523 S 1/1997 Marvin et al.
5,591,253 A 1/1997 Altman et al.
5,591,334 A 1/1997 Shimizu et al.

5,591,412 A 1/1997 Jones et al.
5,593,476 A 1/1997 Coppom
5,601,636 A 2/1997 Glucksman
5,603,752 A 2/1997 Hara
5,603,893 A 2/1997 Gundersen et al.
5,614,002 A 3/1997 Chen
5,624,476 A 4/1997 Eyraud
5,630,866 A 5/1997 Gregg
5,630,990 A 5/1997 Conrad et al.
5,637,198 A 6/1997 Breault
5,637,279 A 6/1997 Besen et al.
5,641,342 A 6/1997 Smith et al.
5,641,461 A 6/1997 Ferone
5,647,890 A 7/1997 Yamamoto
5,648,049 A 7/1997 Jones et al.
5,655,210 A 8/1997 Gregoire et al.
5,656,063 A 8/1997 Hsu
5,665,147 A 9/1997 Taylor et al.
5,667,563 A 9/1997 Silva, Jr.
5,667,564 A 9/1997 Weinberg
5,667,565 A 9/1997 Gondar
5,667,756 A 9/1997 Ho
5,669,963 A 9/1997 Horton et al.
5,678,237 A 10/1997 Powell et al.
5,681,434 A 10/1997 Eastlund
5,681,533 A 10/1997 Hiromi
5,698,164 A 12/1997 Kishioka et al.
5,702,507 A 12/1997 Wang
D389,567 S 1/1998 Gudefin
5,766,318 A 6/1998 Loreth et al.
5,779,769 A 7/1998 Jiang
5,814,135 A 9/1998 Weinberg
5,879,435 A 3/1999 Satyapal et al.
5,893,977 A 4/1999 Pucci
5,911,957 A 6/1999 Khatchatrian et al.
5,972,076 A 10/1999 Nichols et al.
5,975,090 A 11/1999 Taylor et al.
5,980,614 A 11/1999 Loreth et al.
5,993,521 A 11/1999 Loreth et al.
5,993,738 A * 11/1999 Goswani ..... 422/22
5,997,619 A 12/1999 Knuth et al.
6,019,815 A 2/2000 Satyapal et al.
6,042,637 A 3/2000 Weinberg
6,063,168 A 5/2000 Nichols et al.
6,086,657 A 7/2000 Freije
6,090,189 A * 7/2000 Wikstrom et al. ..... 96/69
6,117,216 A 9/2000 Loreth
6,118,645 A 9/2000 Partridge
6,126,722 A 10/2000 Mitchell et al.
6,126,727 A 10/2000 Lo
6,149,717 A 11/2000 Satyapal et al.
6,149,815 A 11/2000 Sauter
6,152,146 A 11/2000 Taylor et al.
6,163,098 A 12/2000 Taylor et al.
6,176,977 B1 1/2001 Taylor et al.
6,182,461 B1 2/2001 Washburn et al.
6,182,671 B1 2/2001 Taylor et al.
6,187,271 B1 * 2/2001 Lee et al. ..... 422/121
6,193,852 B1 2/2001 Caracciolo et al.
6,203,600 B1 3/2001 Loreth
6,212,883 B1 4/2001 Kang
6,228,149 B1 5/2001 Alenichev et al.
6,251,171 B1 * 6/2001 Marra et al. ..... 96/69
6,252,012 B1 6/2001 Egitto et al.
6,270,733 B1 8/2001 Rodden
6,277,248 B1 8/2001 Ishioka et al.
6,282,106 B1 8/2001 Grass
D449,097 S 10/2001 Smith et al.
D449,679 S 10/2001 Smith et al.
6,296,692 B1 10/2001 Gutmann
6,302,944 B1 10/2001 Hoenig
6,309,514 B1 10/2001 Conrad et al.
6,312,507 B1 11/2001 Taylor et al.
6,315,821 B1 11/2001 Pillion et al.
6,328,791 B1 12/2001 Pillion et al.
6,348,103 B1 2/2002 Ahlborn et al.
6,350,417 B1 2/2002 Lau et al.
6,362,604 B1 3/2002 Cravey
6,372,097 B1 4/2002 Chen
6,373,723 B1 4/2002 Wallgren et al.
6,379,427 B1 4/2002 Siess
6,391,259 B1 5/2002 Malkin et al.
6,447,587 B1 9/2002 Pillion et al.
6,451,266 B1 9/2002 Lau et al.
6,464,754 B1 10/2002 Ford
6,471,753 B1 10/2002 Ahn et al.
6,504,308 B1 1/2003 Krichtafovitch et al.
6,506,238 B1 * 1/2003 Endo ..... 96/79
6,544,485 B1 4/2003 Taylor
6,585,935 B1 7/2003 Taylor et al.
6,588,434 B1 7/2003 Taylor et al.
6,603,268 B1 8/2003 Lee
6,613,277 B1 9/2003 Monagan
6,632,407 B1 10/2003 Lau et al.
6,635,105 B1 10/2003 Ahlborn et al.
6,672,315 B1 1/2004 Taylor et al.
6,709,484 B1 3/2004 Lau et al.
6,713,026 B1 3/2004 Taylor et al.
6,735,830 B1 5/2004 Merciel
6,749,667 B1 6/2004 Reeves et al.
6,753,652 B1 6/2004 Kim
6,761,796 B1 7/2004 Srivastava et al.
6,768,108 B1 7/2004 Hirano et al.
6,768,110 B1 7/2004 Alani
6,768,120 B1 7/2004 Leung et al.
6,768,121 B1 7/2004 Horsky
6,770,878 B1 8/2004 Uhlemann et al.
6,774,359 B1 8/2004 Hirabayashi et al.
6,777,686 B1 8/2004 Olson et al.
6,777,699 B1 8/2004 Miley et al.
6,777,882 B1 8/2004 Goldberg et al.
6,781,136 B1 8/2004 Kato
6,785,912 B1 9/2004 Julio
6,791,814 B1 9/2004 Adachi et al.
6,794,661 B1 9/2004 Tsukihara et al.
6,797,339 B1 9/2004 Akizuki et al.
6,797,964 B1 9/2004 Yamashita
6,799,068 B1 9/2004 Hartmann et al.
6,800,862 B1 10/2004 Matsumoto et al.
6,803,585 B1 10/2004 Glukhoy
6,805,916 B1 10/2004 Cadieu
6,806,035 B1 10/2004 Atireklapvarodom et al.
6,806,163 B1 10/2004 Wu et al.
6,806,468 B1 10/2004 Laiko et al.
6,808,606 B1 10/2004 Thomsen et al.
6,809,310 B1 10/2004 Chen
6,809,312 B1 10/2004 Park et al.
6,809,325 B1 10/2004 Dahl et al.
6,812,647 B1 11/2004 Cornelius
6,815,690 B1 11/2004 Veerasamy et al.
6,818,257 B1 11/2004 Amann et al.
6,818,909 B1 11/2004 Murrell et al.
6,819,053 B1 11/2004 Johnson
6,863,869 B1 3/2005 Taylor et al.
6,896,853 B1 5/2005 Law et al.
6,911,186 B1 6/2005 Taylor et al.
2001/0004046 A1 6/2001 Taylor et al.
2001/0048906 A1 12/2001 Lau et al.
2002/0069760 A1 6/2002 Pruette et al.
2002/0079212 A1 6/2002 Taylor et al.
2002/0098131 A1 7/2002 Taylor et al.
2002/0100488 A1 8/2002 Taylor et al.
2002/0122751 A1 9/2002 Sinaiko et al.
2002/0122752 A1 9/2002 Taylor et al.
2002/0127156 A1 9/2002 Taylor
2002/0134664 A1 9/2002 Taylor et al.

| | | | |
|---|---|---|---|
| 2002/0134665 | A1 | 9/2002 | Taylor et al. |
| 2002/0141914 | A1 | 10/2002 | Lau et al. |
| 2002/0144601 | A1 | 10/2002 | Palestro et al. |
| 2002/0146356 | A1 | 10/2002 | Sinaiko et al. |
| 2002/0150520 | A1 | 10/2002 | Taylor et al. |
| 2002/0152890 | A1 | 10/2002 | Leiser |
| 2002/0155041 | A1 | 10/2002 | McKinney, Jr et al. |
| 2002/0170435 | A1 | 11/2002 | Joannou |
| 2002/0190658 | A1 | 12/2002 | Lee |
| 2002/0195951 | A1 | 12/2002 | Lee |
| 2003/0005824 | A1 | 1/2003 | Katou et al. |
| 2003/0170150 | A1 | 9/2003 | Law et al. |
| 2003/0196887 | A1 | 10/2003 | Lau et al. |
| 2003/0206837 | A1 | 11/2003 | Taylor et al. |
| 2003/0206839 | A1 | 11/2003 | Taylor et al. |
| 2003/0206840 | A1 | 11/2003 | Taylor et al. |
| 2004/0033176 | A1 | 2/2004 | Lee et al. |
| 2004/0052700 | A1 | 3/2004 | Kotlyar et al. |
| 2004/0065202 | A1 | 4/2004 | Gatchell et al. |
| 2004/0096376 | A1 | 5/2004 | Taylor |
| 2004/0136863 | A1 | 7/2004 | Yates et al. |
| 2004/0166037 | A1 | 8/2004 | Youdell et al. |
| 2004/0226447 | A1 | 11/2004 | Lau et al. |
| 2004/0234431 | A1 | 11/2004 | Taylor et al. |
| 2004/0237787 | A1 | 12/2004 | Reeves et al. |
| 2004/0251124 | A1 | 12/2004 | Lau |
| 2004/0251909 | A1 | 12/2004 | Taylor et al. |
| 2005/0000793 | A1 | 1/2005 | Taylor et al. |

FOREIGN PATENT DOCUMENTS

| | | | |
|---|---|---|---|
| CN | 2138764 | Y | 6/1993 |
| CN | 2153231 | Y | 12/1993 |
| DE | 2206057 | | 8/1973 |
| DE | 197 41 621 C 1 | | 6/1999 |
| EP | 0433152 | A1 | 12/1990 |
| EP | 0332624 | B1 | 1/1992 |
| FR | 2690509 | | 10/1993 |
| GB | 643363 | | 9/1950 |
| JP | S51-90077 | | 8/1976 |
| JP | S62-20653 | | 2/1987 |
| JP | S63-164948 | | 10/1988 |
| JP | 10137007 | | 5/1998 |
| JP | 10216561 | | 8/1998 |
| JP | 11104223 | | 4/1999 |
| JP | 2000236914 | | 9/2000 |
| WO | WO 92/05875 | A1 | 4/1992 |
| WO | WO 96/04703 | A1 | 2/1996 |
| WO | WO 99/07474 | A1 | 2/1999 |
| WO | WO00/10713 | A1 | 3/2000 |
| WO | WO 01/47803 | A1 | 7/2001 |
| WO | WO 01/48781 | A1 | 7/2001 |
| WO | WO01/64349 | A1 | 9/2001 |
| WO | WO01/85348 | A2 | 11/2001 |
| WO | WO02/20162 | A2 | 3/2002 |
| WO | WO02/20163 | A2 | 3/2002 |
| WO | WO02/30574 | A1 | 4/2002 |
| WO | WO02/32578 | A1 | 4/2002 |
| WO | WO02/42003 | A1 | 5/2002 |
| WO | WO02/066167 | A1 | 8/2002 |
| WO | WO03/009944 | A1 | 2/2003 |
| WO | WO03/013620 | A1 | 2/2003 |
| WO | WO 03/013734 AA | | 2/2003 |

OTHER PUBLICATIONS

U.S. Appl. No. 10/405,193, filed Apr. 1, 2003, Taylor.
"Zenion Elf Device," drawing, prior art, undated.
Electrical schematic and promotional material available from Zenion Industries, 7 pages, Aug. 1990.
Promotional material available from Zenion Industries for the Plasma-Pure 100/200/300, 2 pages, Aug. 1990.
Promotional material available from Zenion Industries for the Plasma-Tron, 2 pages, Aug. 1990.
LENTEK Sila™ Plug-In Air Purifier/Deodorizer product box copyrighted 1999, 13 pages.
Blueair A V 402 Air Purifier, shown at http://www.air-purifiers-usa.biz/Blueair_AV402.htm, on Aug. 24, 2004.
Blueair AV 501 Air Purifier, shown at http://www.air-purifiers-usa.biz/Blueair_AV501.htm, on Aug. 24, 2004.
ConsumerReports.org, "Air Cleaners: Behind the Hype," http://www.consumerreports.org/main/content/printable.jsp?FOLDER%3C%3EFOLDER_id, Oct. 2003.
Electrical schematic and promotional material available from Zenion Industries, 7 pages, Aug. 1990.
Friedrich C-90A Electronic Air Cleaner, Service Information, Friedrich Air Conditioning Co., Jan. 1, 2003.
Friedrich C-90A, "How the C-90 Works," BestAirCleaner.com http://www.bestaircleaner.com/faq/c90works.asp, 1 page, undated.
"Household Air Cleaners," Consumer Reports Magazine, Oct. 1992.
LakeAir Excel and Maxum Portable Electronic Air Cleaners, Operating and Service Manual, LakeAir International, Inc., 11 pp. 1971.
Trion 120 Air Purifier, Model 442501-025, shown at http://www.feddersoutled.com/trion120.html, on Jul. 19, 2004.
Trion 150 Air Purifier, Model 45000-002, shown at http://www.feddersoutlet.com/trion150.html, on Jul. 19, 2004.
Trion 350 Air Purifier, Model 450111-010, shown at http://www.feddersoutlet.com/trion350.html, on Jul. 19, 2004.
Trion Console 250 Electronic Air Cleaner, Model Series 442857 and 445600, Manual for Installation•Operation•Maintenance, Trion Inc., Nov. 1995.

* cited by examiner

ELECTROSTATIC PRECIPITATORS WITH INSULATED DRIVER ELECTRODES

PRIORITY CLAIM

The present application is a continuation-in-part of U.S. patent application Ser. No. 10/717,420 filed Nov. 19, 2003, entitled "Electro-Kinetic Air Transporter and Conditioner Devices with Insulated Driver Electrodes", which claims priority under 35 U.S.C. 119(e) to U.S. Provisional Patent Application No. 60/500,437, filed Sep. 5, 2003, entitled "Electro-Kinetic Air Transporter and Conditioner Devices with Insulated Driver Electrodes", both of which are incorporated by reference herein, and to both of which the present application claims priority.

CROSS-REFERENCE TO RELATED ART

The present invention is related to the following patent application and patent, each of which is incorporated herein by reference: U.S. patent application Ser. No. 10/074,207, filed Feb. 12, 2002, entitled "Electro-Kinetic Air Transporter-Conditioner Devices with Interstitial Electrode"; and U.S. Pat. No. 6,176,977, entitled "Electro-Kinetic Air Transporter-Conditioner."

FIELD OF THE INVENTION

The present invention relates generally to electrostatic precipitator (ESP) systems.

BACKGROUND OF THE INVENTION

An example of a conventional electrostatic precipitator (ESP), module or system 100 is depicted in simplified form in FIG. 1A. The exemplary ESP module 100 includes a corona discharge electrode 102 (also known as an emitter electrode) and a plurality of collector electrodes 104. A driver electrode 106 is located between each pair of collector electrodes. In the embodiment shown there are four collector electrodes 104*a*, 104*b*, 104*c* and 104*d*, and three driver electrodes 106*a*, 106*b* and 106*c*. The corona discharge electrode 102, which is likely a wire, is shown as receiving a negative charge. The collector electrodes 104, which are likely metal plates, are shown as receiving a positive charge. The driver electrodes 106, which are also likely metal plates, are shown as receiving a negative charge. FIG. 1B illustrates exemplary dimensions for the system or module of FIG. 1A.

The voltage difference between the discharge electrode 102 and the upstream portions or ends of the collector electrodes 104 create a corona discharge from the discharge electrode 102. This corona discharge ionizes (i.e., charges) the air in the vicinity of the discharge electrode 102 (i.e., within the ionization region 110). As air flows through the ionization region 110, in the direction indicated by an arrow 150, particulate matter in the airflow is charged (in this case, negatively charged). As the charged particulate matter moves toward the collector region 120, the particulate matter is electrostatically attracted to and collects on the surfaces of the collector electrodes 104, where it remains, thus conditioning the flow of air. Further, the corona discharge produced by the electrode 102 can release ozone into the ambient environment, which can eliminate odors that are entrained in the airflow, but is generally undesirable in excess quantities. The driver electrodes 106, which have a similar charge as the particles (negative, in this case) repel or push the particles toward the collector electrodes 104, thereby increasing precipitation efficiency (also known as collection efficiency). However, because the negatively charged driver electrodes 106 are located close to adjacent positively charged collector electrodes 104, undesirable arcing (also known as breakdown or sparking) will occur between the collector electrodes 104 and the driver electrodes 106 if the potential difference there-between is too high, or if a carbon path is produced between the a collecting electrode 104 and a driver electrode 106 (e.g., due to a moth or other insect that got stuck between an electrode 104 and electrode 106, or due to dust buildup). It is also noted that driver electrodes 106 are sometimes referred to as interstitial electrodes, because they are situated between other (i.e., collector) electrodes.

Increasing the voltage difference between the driver electrodes 106 and the collector electrodes 108 is one way to further increase particle collecting efficiency. However, the extent that the voltage difference can be increased is limited because arcing will eventually occur between the collector electrodes 104 and the driver electrodes 106. Such arcing will typically decrease the collecting efficiency of the system.

Accordingly, there is a desire to improve upon existing ESP techniques. More specifically, there is a desire to increase particle collecting efficiency and to reduce arcing between electrodes.

SUMMARY OF THE PRESENT INVENTION

Embodiments of the present invention are related to ESP systems and methods. In accordance with an embodiment of the present invention, a system includes at least one corona discharge electrode (also known as an emitter electrode) and at least one collector electrode that extends downstream from the corona discharge electrode. An insulated driver electrode is located adjacent the collector electrode. In embodiments where there are at least two collector electrodes, an insulated driver electrode is located between each pair of adjacent electrodes. A high voltage source provides a voltage potential difference between the corona discharge electrode(s) and the collector electrode(s). The insulated driver electrode(s) may or may not be at a same voltage potential as the corona discharge electrode, but should be at a different voltage potential than the collector electrode(s).

The insulation (i.e., dielectric material) on the driver electrodes allows the voltage potential to be increased between the driver and collector electrodes, to a voltage potential that would otherwise cause arcing if the insulation were not present. This increased voltage potential increases particle collection efficiency. Additionally, the insulation will reduce, and likely prevent, any arcing from occurring, especially if a carbon path is formed between the collector and driver electrodes, e.g., due to an insect getting caught therebetween.

In accordance with an embodiment of the present invention, the corona discharge electrode(s) and the insulated driver electrode(s) are grounded, while the high voltage source is used to provide a high voltage potential to the collector electrode(s). This is a relatively easy embodiment to implement, since the high voltage source need only provide one polarity.

In accordance with an embodiment of the present invention, the corona discharge electrode(s) is at a first voltage potential, the collector electrode(s) is at a second voltage potential different than the first voltage potential, and the insulated driver electrode is at a third voltage potential different than the first and second voltage potentials. One of the first, second and third voltage potentials can be ground, but need not be. Other variations, such as the corona discharge and driver electrodes being at the same potential (ground or otherwise) are within the scope of the invention.

In accordance with a preferred embodiment of the present invention, the upstream end of each insulated driver electrode is may be set back a distance from the upstream end of the collector electrode(s), it is however within the scope of the invention to have the upstream end of each insulated driver electrode to be substantially aligned with or set forward a distance from the upstream end of the collector electrode, depending upon spacing within the unit.

In accordance with one embodiment of the present invention, an insulated driver electrode includes generally flat elongated sides that are generally parallel with the adjacent collector electrode(s), for example a printed circuit board (pcb). Alternatively, an insulated driver electrode can include one, or preferably a row of, insulated wire-shaped electrodes.

Each insulated driver electrode includes an underlying electrically conductive electrode that is covered with, a dielectric material. The dielectric material can be, for example, an additional layer of insulated material used on a pcb, heat shrink tubing material, an insulating varnish type material, or a ceramic enamel. In accordance with an embodiment of the present invention, the dielectric material may be coated with an ozone reducing catalyst. In accordance with another embodiment of the present invention, the dielectric material may include or is an ozone reducing catalyst.

Other features and advantages of the invention will appear from the following description in which the preferred embodiments have been set forth in detail, in conjunction with the accompanying drawings and claims.

BRIEF DESCRIPTIONS OF THE FIGURES

FIG. 10 also includes exemplary dimensions for the ESP system.

DETAILED DESCRIPTION

Figure 1A:
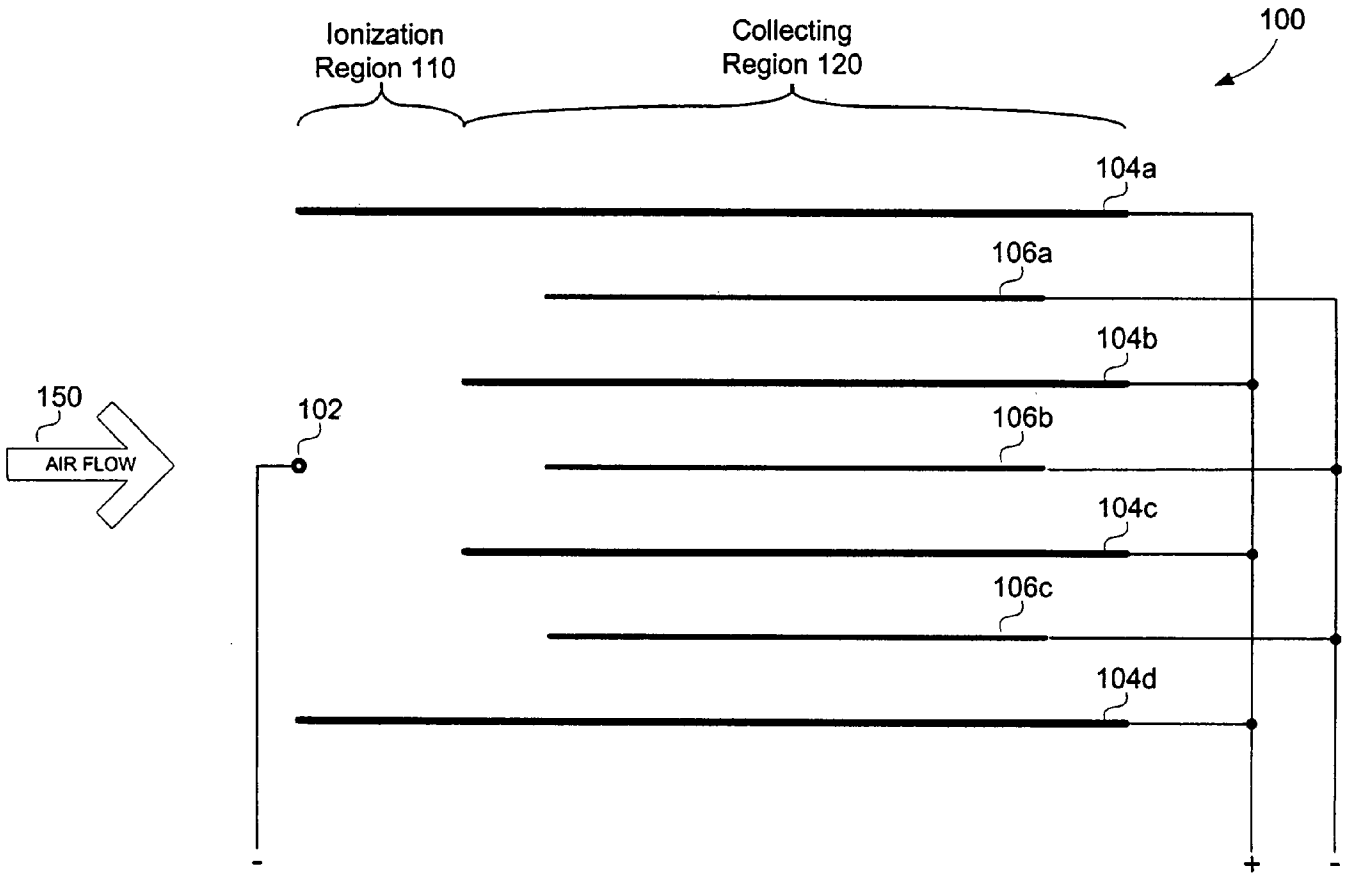
FIG. 1A PRIOR ART
FIG. 1A illustrates schematically, a conventional ESP system.
Figure 2A:
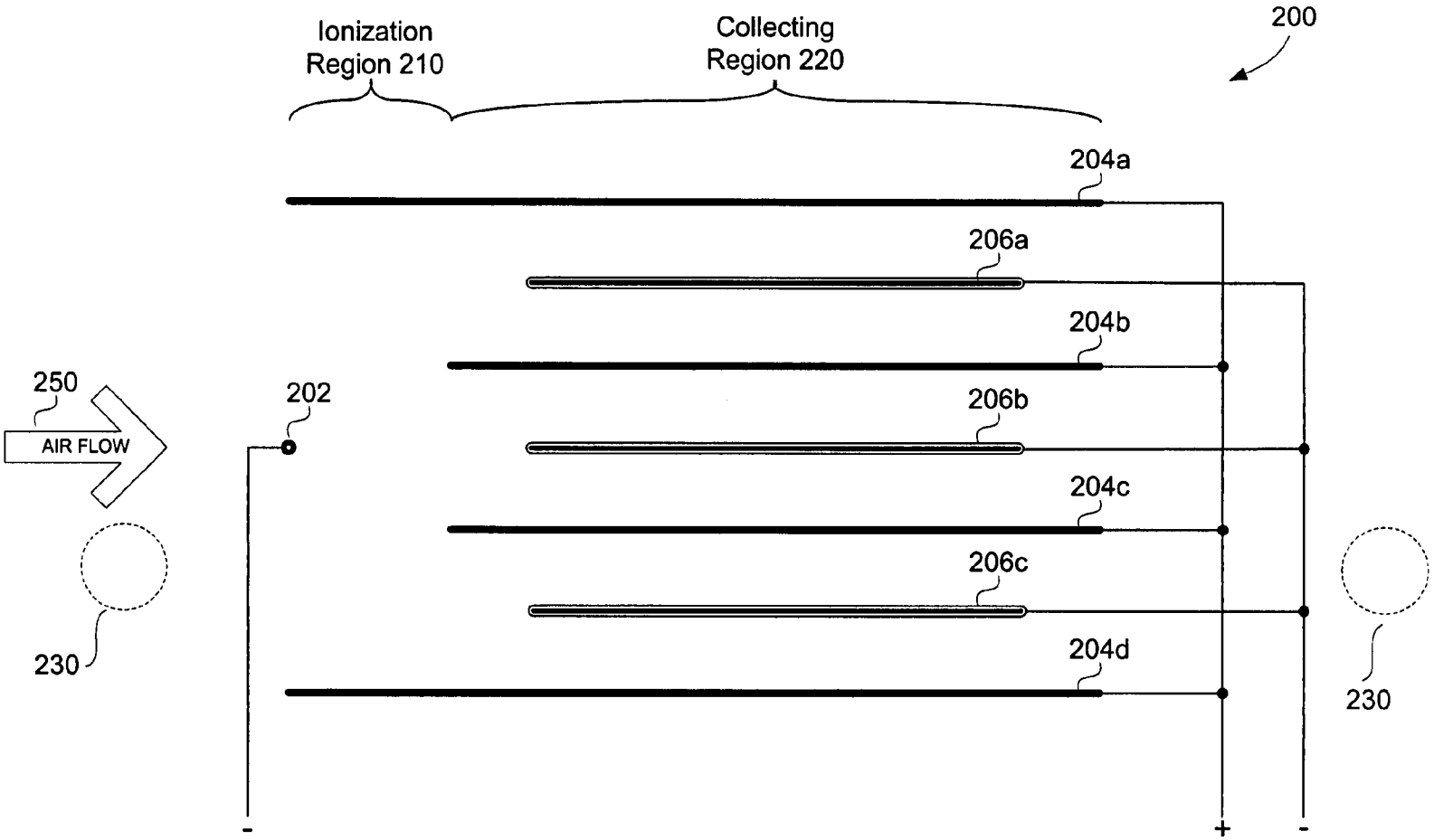
FIG. 2A illustrates schematically, an ESP system according to an embodiment of the present invention.
Figure 2B:
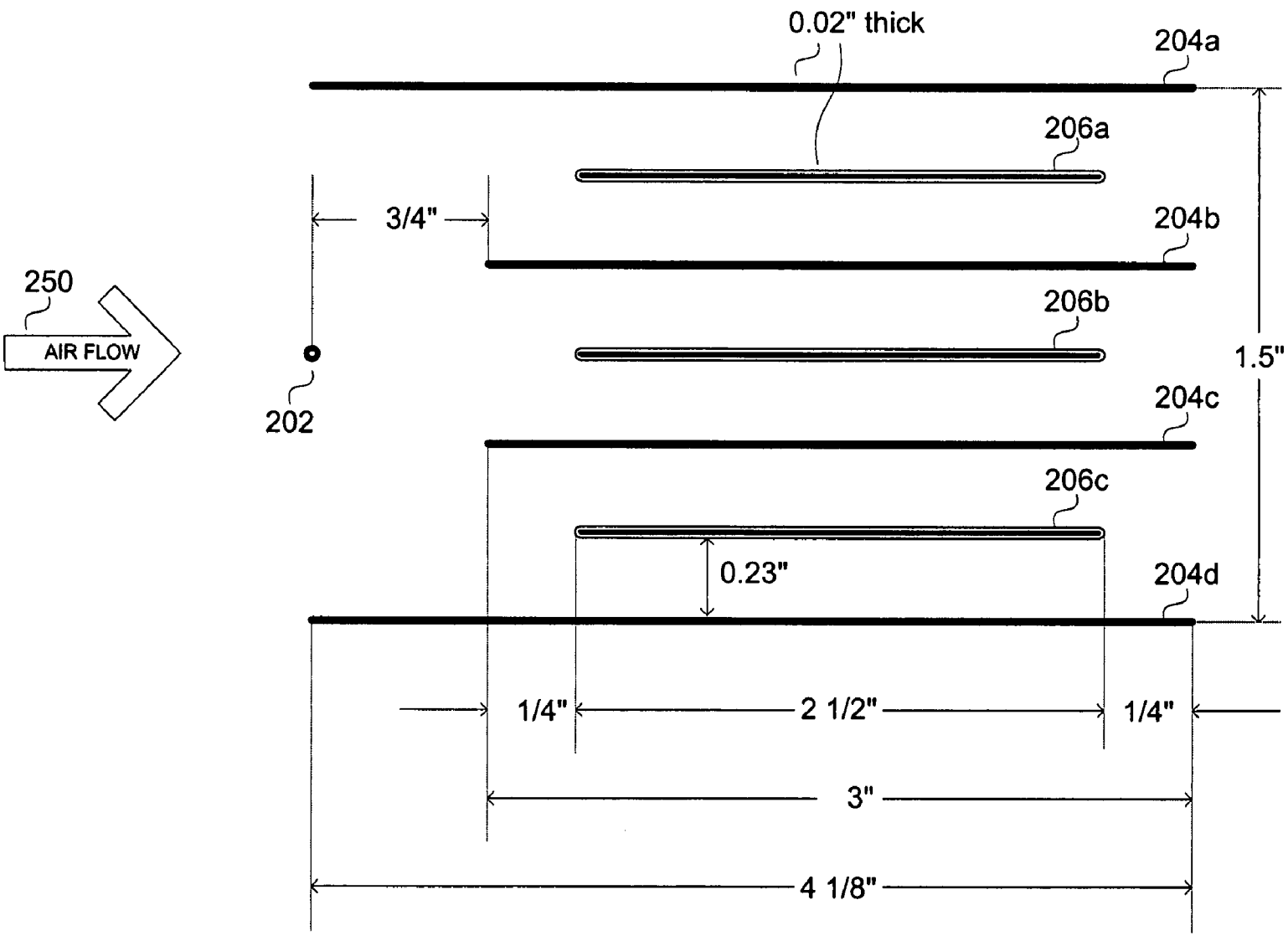
FIG. 2B illustrates exemplary dimensions for the ESP system of FIG. 2A.

FIG. 2A illustrates schematically, an ESP module or system 200, according to an embodiment of the present invention. The system 200 includes a corona discharge electrode 202 (also known as an emitter electrode) and a plurality of collector electrodes 204. An insulated driver electrode 206 is located between each pair of collector electrodes. In the embodiment shown there are four collector electrodes 204*a*, 204*b*, 204*c* and 204*d*, and three driver electrodes 206*a*, 206*b* and 206*c*. In this embodiment, the corona discharge electrode 202 is shown as receiving a negative charge. The collector electrodes 204, which are likely metal plates, are shown as receiving a positive charge. The driver electrodes 206, which are also likely metal plates, are shown as receiving a negative charge. FIG. 2B illustrates exemplary dimensions for the system or module of FIG. 2A. A comparison between FIGS. 1A and 2A reveals that the only difference between the two figures is that the driver electrodes in FIG. 2A are insulated. The use of insulated driver electrodes 206 provides advantages, which are discussed below.

Figure 2C:
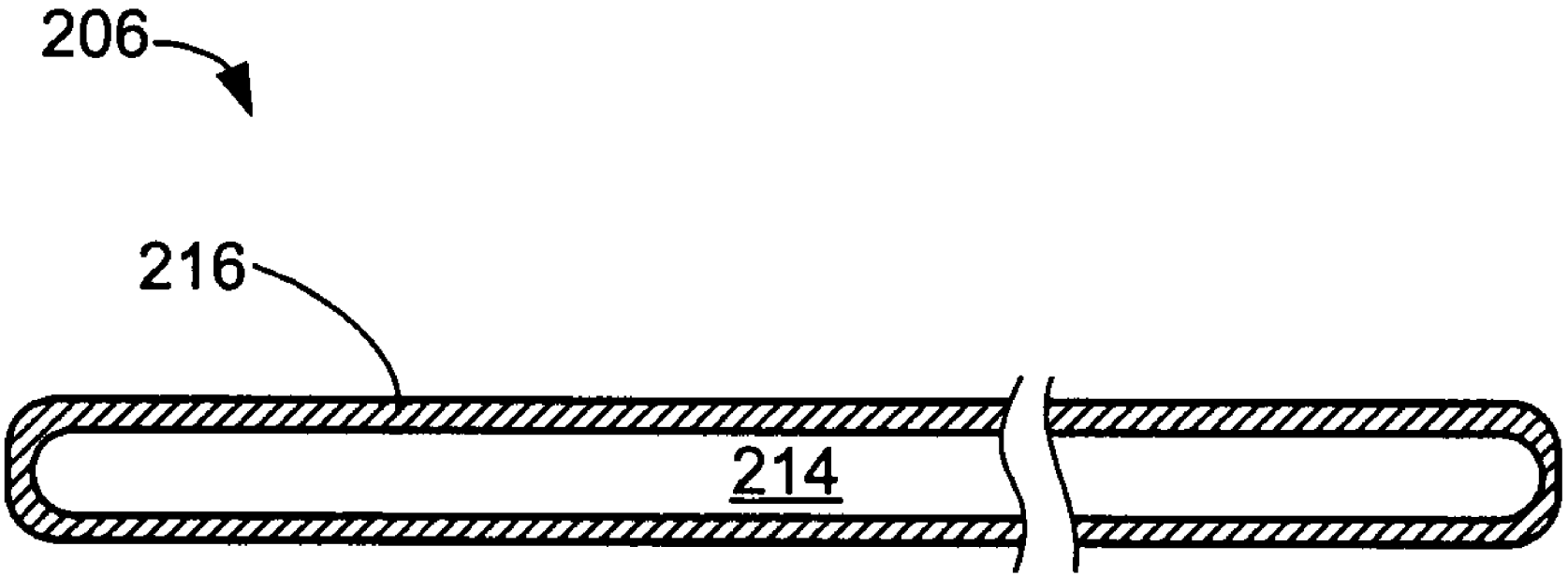
FIG. 2C is a cross section of an insulated driver electrode, according to an embodiment of the present invention.

As shown in FIG. 2C (which is a cross section of an insulated driver electrode 206), each insulated driver electrode 206 includes an underlying electrically conductive electrode 214 that is covered by a dielectric material 216. In accordance with one embodiment of the present invention, the electrically conductive electrode is located on a printed circuit board (pcb) covered by one or more additional layers of insulated material 216. Exemplary insulated pcb's are generally commercially available and may be found from a variety of sources, including for example Electronic Service and Design Corp, of Harrisburg, Pa. Alternatively, the dielectric material could be heat shrink tubing wherein during manufacture, heat shrink tubing is placed over the conductive electrodes 214 and then heated, which causes the tubing to shrink to the shape of the conductive electrodes 214. An exemplary heat shrinkable tubing is type FP-301 flexible polyolefin tubing available from 3M of St. Paul, Minn.

Alternatively, the dielectric material 216 may be an insulating varnish, lacquer or resin. For example, a varnish, after being applied to the surface of a conductive electrode, dries and forms an insulating coat or film, a few mils (thousands of an inch) in thickness, covering the electrodes 214. The dielectric strength of the varnish or lacquer can be, for example, above 1000 V/mil (Volts per thousands of an inch). Such insulating varnishes, lacquers and resins are commercially available from various sources, such as from John C. Dolph Company of Monmouth Junction, N.J., and Ranbar Electrical Materials Inc. of Manor, Pa.

Other possible dielectric materials that can be used to insulate the driver electrodes include ceramic or porcelain enamel or fiberglass. These are just a few examples of dielectric materials that can be used to insulate the driver electrodes 206. It is within the spirit and scope of the present invention that other insulating dielectric materials can be used to insulate the driver electrodes.

During operation of system 200, the corona discharge electrode 202 and the insulated driver electrodes 206 are negatively charged, and the collector electrodes 206 are positively charged. The same negative voltage can be applied to both the corona discharge electrode 202 and the insulated driver electrodes 206. Alternatively, the corona discharge electrode 202 can receive a different negative charge than the insulated driver electrodes 206. In the ionization region 210, the high voltage potential difference between the corona discharge electrode 202 and the collector electrodes 204 produces a high intensity electric field that is highly concentrated around the corona discharge electrode 202. More specifically, a corona discharge takes place from the corona discharge electrode 202 to the collector electrodes 204, producing negatively charged ions. Particles (e.g., dust particles) in the airflow (represented by arrow 250) that move through the ionization region 210 are negatively charged by the ions. The negatively charged particles are repelled by the negatively charged discharge electrodes 202, and are attracted to and deposited on the positively charged collector, electrodes 204.

Further electric fields are produced between the insulated driver electrodes 206 and the collector electrodes 204, which further push the positively charged particles toward the collector electrodes 204. Generally, the greater this electric field between the driver electrodes 206 and the collector electrodes 204, the greater the migration velocity and the particle collection efficiency. Conventionally, the extent that this voltage difference (and thus, the electric field) could be increased was limited because arcing would occur between the collector electrodes and un-insulated driver electrodes beyond a certain voltage potential difference. However, with the present invention, the insulation 216 covering electrical conductor 214 significantly increases the voltage potential difference that can be obtained between the collector electrodes 204 and the driver electrodes 206 without arcing. The increased potential difference results in an increased electric field, which significantly increases particle collecting efficiency. By analogy, the insulation 216 works much the same way as a dielectric material works in a parallel plate capacitor. That is, even though a parallel plate capacitor can be created with only an air gap between a pair of differently charged conductive plates, the electric field can be significantly increased by placing a dielectric material between the plates.

The airflow 250 can be generated in any manner. For example, the air flow could be created with forced air circulation. Such forced are circulation can be created, for example, by a fan upstream from the ionization region 210 pushing the air toward the collecting region. Alternatively, the fan may be located downstream from the ionization region 210 pulling the air toward the collecting region. The airflow may also be generated electrostatically. These examples are not meant to be limiting.

Referring back to FIG. 2A, a germicidal (e.g., ultra-violet) lamp 230, can be located upstream and/or downstream from the electrodes, to destroy germs within the airflow. Although the lamps 230 are not shown in many of the following FIGS., it should be understood that a germicidal lamp can be used in all embodiments of the present invention. Additional details of the inclusion of a germicidal lamp are provided in U.S. Pat. No. 6,544,485, entitled "Electro-Kinetic Device with Enhanced Anti-Microorganism Capability," and U.S. patent application Ser. No. 10/074,347, entitled "Electro-Kinetic Air Transporter and Conditioner Device with Enhanced Housing Configuration and Enhanced Anti-Microorganism Capability," each of which is incorporated herein by reference.

Figure 3:
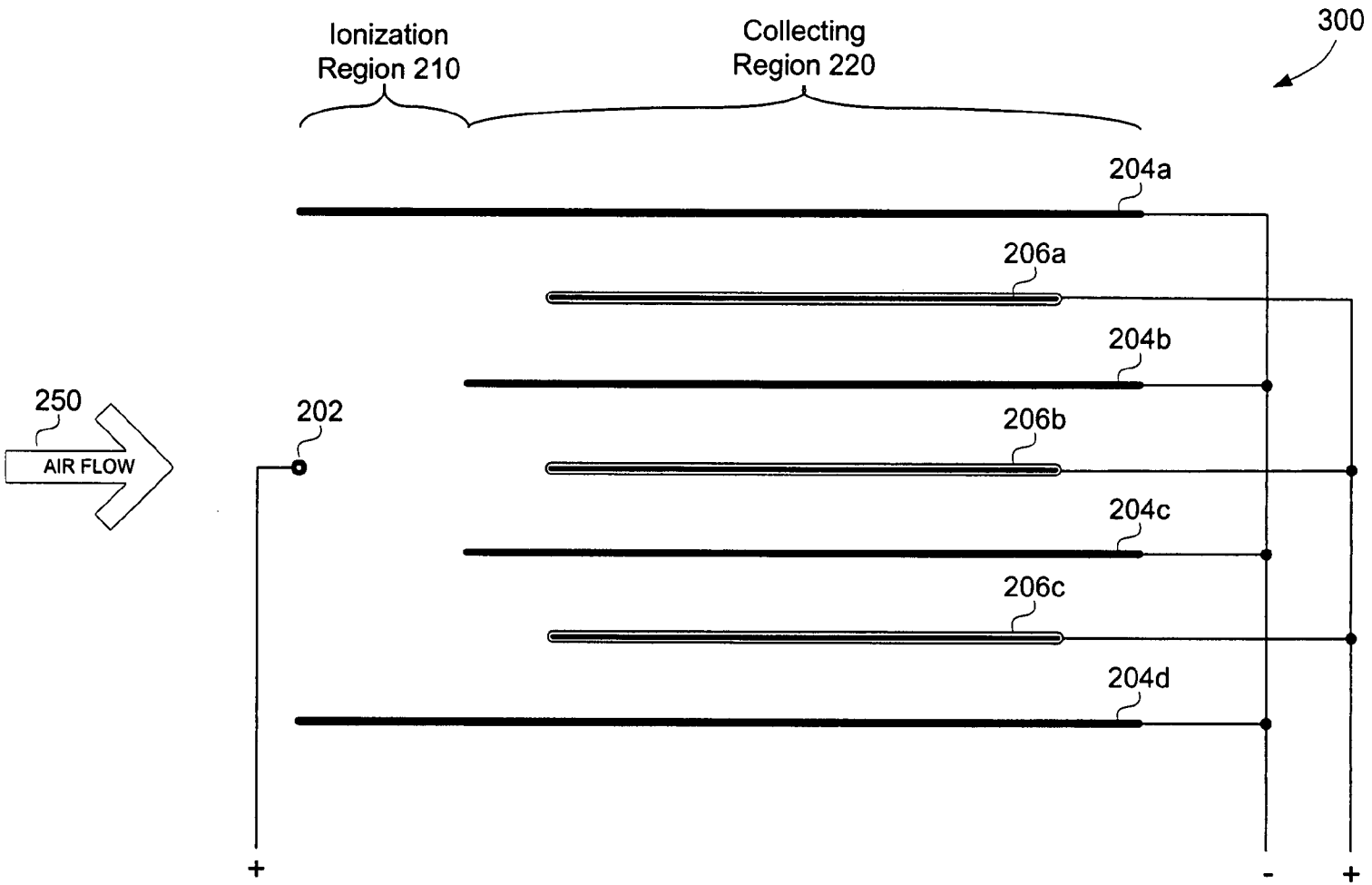
FIGS. 3–5 illustrate schematically, ESP systems according to alternative embodiments of the present invention.

FIG. 3 illustrates schematically, an ESP module or system 300 according to another embodiment of the present invention. The arrangement of system 300 is similar to that of system 200 (and thus, is numbered in the same manner), except that the corona discharge electrode 202 and insulated driver electrodes 206 are positively charged, and the collector electrodes 204 are negatively charged.

The ESP system 300 operates in a similar manner to system 200. More specifically, in the ionization-region 110, the high voltage potential difference between the corona discharge electrode 202 and the collector electrodes 204 produces a high intensity electric field that is highly concentrated around the corona discharge electrode 202. This causes a corona discharge to take place from the corona discharge electrode 202 to the collector electrodes 204, producing positively charged ions. Particles (e.g., dust particles) in the vicinity of the corona discharge electrode are positively charged by the ions. The positively charged particles are repelled by the positively charged discharge electrode 202, and are attracted to and deposited on the negatively charged collector electrodes 204. The further electric fields produced between the insulated driver electrodes 206 and collector electrodes 204, further push the positively charged particles toward the collector electrodes 204. While system 300 may have a collection efficiency similar to that of system 200, system 300 will output air that includes excess positive ions, which are less desirable than the negatively charged ions that are produced using system 200.

Figure 4:
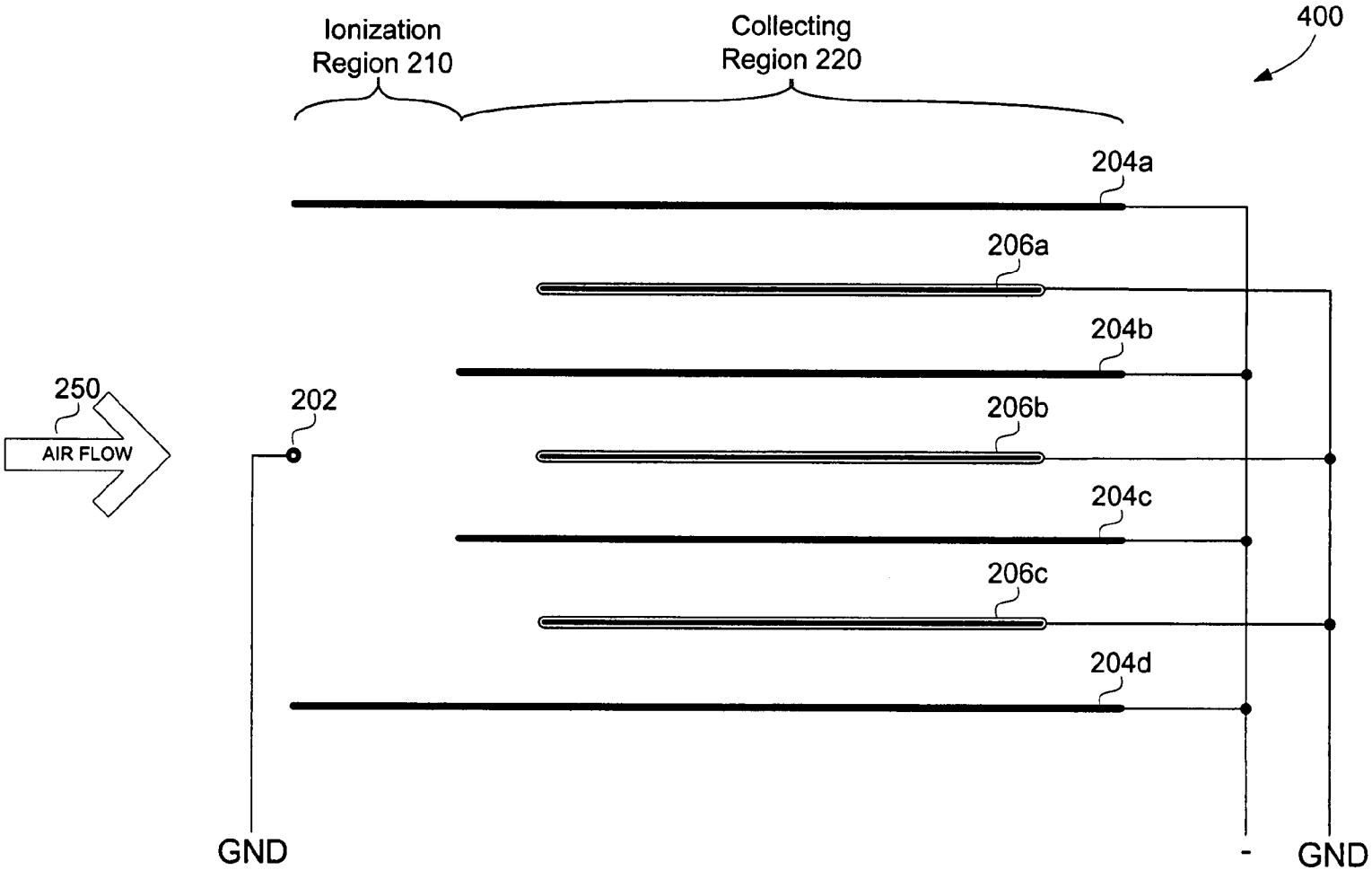

FIG. 4 illustrates schematically, an ESP module or system 400, according to still another embodiment of the present invention. In the arrangement of system 400, the corona discharge electrode 202 and insulated driver electrodes 206 are grounded, and the collector electrodes 204 are negatively charged. In ESP system 400, the high voltage potential difference between the grounded corona discharge electrode 202 and the collector electrodes 204 produces a high intensity electric field that is highly concentrated within the ionization region 210 around the corona discharge electrode 202. More specifically, the corona discharge takes place from the corona discharge electrode 202 to the collector electrodes 204, producing positive ions. This causes particles (e.g., dust particles) in the vicinity of corona discharge electrode 202 to become positively charged relative to the collector electrodes 204. These particles are attracted to and deposited on the negatively charged collector electrodes 204. The further electric fields produced between the insulated driver electrodes 206 and collector electrodes 204, further push the charged particles toward the collector electrodes 204.

Figure 5:
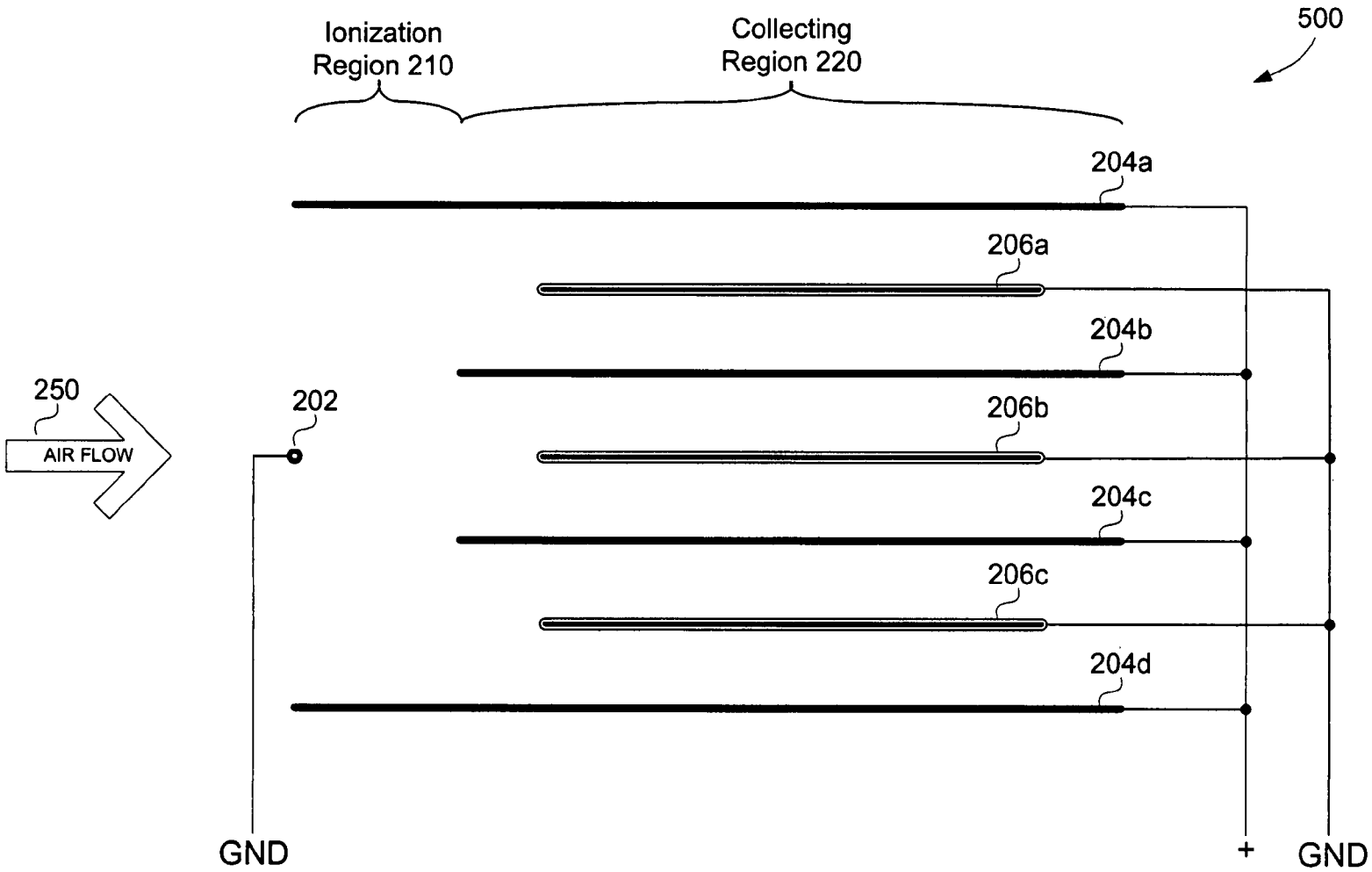

FIG. 5 illustrates schematically, an ESP module or system 500, according to a further embodiment of the present invention. The arrangement of system 500 is similar to that of system 400, except the collector electrodes are now positively charged. System 500 operates similar to system 400, except system 500 produces excess negative ions, which are preferred to the excess positive ions produced by system 400.

To summarize, in system 200 shown in FIG. 2, the corona discharge electrode is negative, the collectors 204 are positive, and the insulated drivers 206 are negative; in system 300 in FIG. 3, the corona discharge electrode is positive, the collectors 204 are negative, and the insulated drivers 206 are positive; in system 400 of FIG. 4, the corona discharge electrode is grounded, the collectors 204 are negative, and the insulated drivers 206 are grounded; in system 500 of FIG. 5, the corona discharge electrode is grounded, the collectors 204 are positive, and the insulated drivers 206 are grounded. In addition to those described above, there are other voltage potential variations that can be used to produce an ESP module or system that includes one or more insulated driver electrodes 206. For example, it would also be possible to modify the system 200 of FIG. 2 so that the insulated driver electrodes 206 were grounded, or so that the insulated driver electrodes were slightly positive (so long as the collector electrodes 204 were significantly more positive). For another example, it would be possible to modify the system 300 of FIG. 3 so that the insulated driver electrodes 206 were grounded, or so that the insulated driver electrodes were slightly negative (so long as the collector electrodes 204 were significantly more negative). Other variations are also possible while still being within the spirit and scope of the present invention. For example, it is also possible that instead of grounding certain portions of the electrode arrangement, the entire arrangement can float (e.g., the corona discharge electrode 202 and insulated driver electrodes 206 can be at a floating voltage potential, with the collector electrodes 204 offset from the floating voltage potential). What is preferred is that there is a high voltage potential between corona electrode 202 and the collector electrodes 204 such that particles are ionized, and that there is a high voltage potential between the insulated driver electrodes 206 and the collectors 204 to drive the ionized particles toward the collectors 204.

According to an embodiment of the present invention, if desired, the voltage potential of the corona discharge electrode 202 and the insulated driver electrodes 206 can be independently adjusted. This allows for corona current adjustment (produced by the electric field between the discharge electrode 202 and collector electrodes 204) to be performed independently of adjustments to the electric fields between the insulated driver electrodes 206 and collector electrodes 204.

Figure 6:
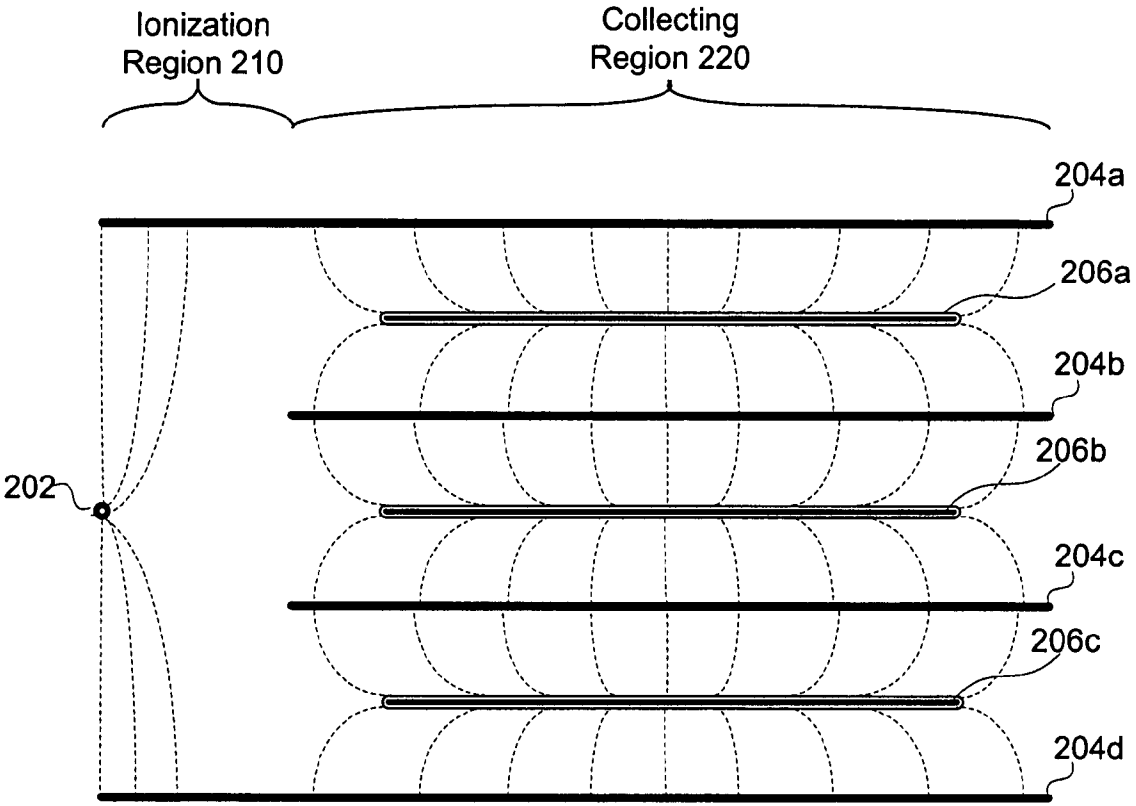
FIG. 6 illustrates schematically, exemplary electric field lines produced between the various electrodes of the embodiment of the present invention.

The electric fields produced between the corona discharge electrode 202 and collector electrodes 204 (in the ionization region 210), and the electric fields produced between the insulated driver electrodes 206 and collector electrodes 204 (in the collector region 220), are shown by exemplary dashed lines in FIG. 6. In addition to the electric field being produced between the corona discharge electrode 202 and the outer collector electrodes 204*a* and 204*d*, as shown in FIG. 6, electric fields (not shown in FIG. 6) may also be produced between the corona discharge electrode 202 and the upstream ends of the inner collector electrodes 204*b* and 204*c*. This depends on the distance between the corona discharge electrode 202 and the collector electrodes 204*b* and 204*c*.

As discussed above, ionization region 210 produces ions that charge particles in the air that flows through the region 210 in a downstream direction toward the collector region 220. In the collector region 220, the charged particles are attracted to the collector electrodes 204. Additionally, the insulated driver electrodes 206 push the charged particles in the air flow toward the collector electrodes 204.

Electric fields produced between the insulated driver electrode 206 and collector electrodes 204 (in the collecting region 220) should not interfere with the electric fields between the corona discharge electrode 202 and the collector electrodes 204 (i.e., the ionization region 210). If this were to occur, the collecting region 220 would reduce the intensity of the ionization region 210.

As explained above, the corona discharge electrode 202 and insulated driver electrodes 206 may or may not be at the same voltage potential, depending on which embodiment of the present invention is practiced. When at the same voltage potential, there will be no problem of arcing occurring between the corona discharge electrode 202 and insulated driver electrodes 206. Further, even when at different potentials, if the insulated driver electrodes 206 are setback as described above, the collector electrodes 204 will shield the insulated driver electrodes 206. Thus, as shown in FIG. 6, there is generally no electric field produced between the corona discharge electrode 202 and the insulated driver electrodes 206. Accordingly, arcing should not occur therebetween.

In addition to producing ions, the systems described above will also produce ozone ($O_3$). While limited amounts of ozone are useful for eliminating odors, concentrations of ozone beyond recommended levels are generally undesirable. In accordance with embodiments of the present invention, ozone production is reduced by coating the insulated driver electrodes 206 with an ozone reducing catalyst. Exemplary ozone reducing catalysts include manganese dioxide and activated carbon. Commercially available ozone reducing catalysts such as PremAir™ manufactured by Englehard Corporation of Iselin, N.J., can also be used. Where the insulated driver electrodes 206 are coated with an ozone reducing catalyst, the ultra-violate radiation from a germicidal lamp may increase the effectiveness of the catalyst. The inclusion of a germicidal lamp 230 is discussed above with reference to FIG. 2A.

Some ozone reducing catalysts, such as manganese dioxide are not electrically conductive, while others, such as activated carbon are electrically conductive. When using a catalyst that is not electrically conductive, the insulation 216 can be coated in any available manner because the catalyst will act as an additional insulator, and thus not defeat the purpose of adding the insulator 216. However, when using a catalyst that is electrically conductive, it is important that the electrically conductive catalyst does not interfere with the benefits of insulating the driver. This will be described with reference to FIG. 7.

Figure 7:
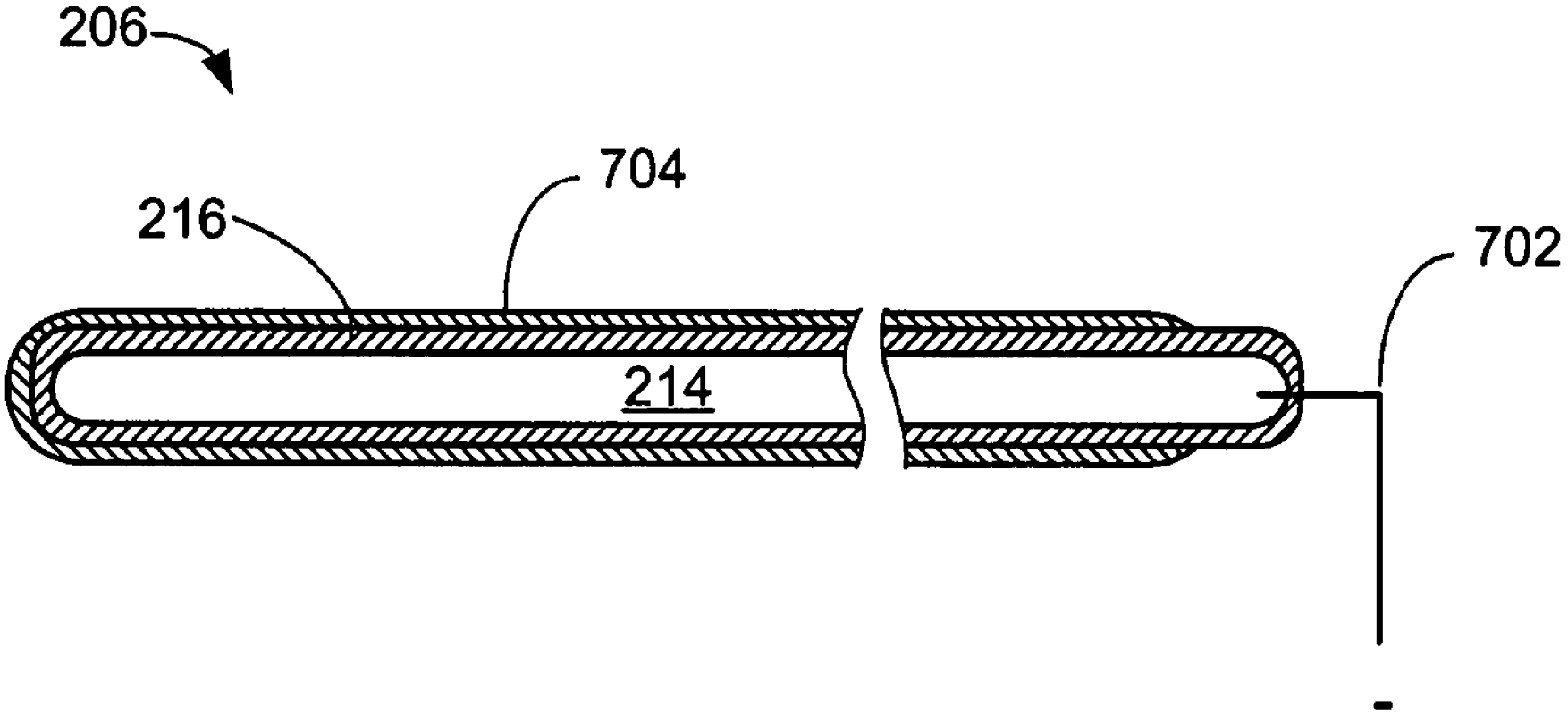
FIG. 7 is a cross section of an insulated driver electrode that is coated with an ozone reducing catalyst, according to an embodiment of the present invention.

Referring now to FIG. 7, the underlying electrically conductive electrode 214 is covered by dielectric insulation 216 to produce an insulated driver electrode 206. The underlying driver electrode 214 is shown as being connected by a wire 702 (or other conductor) to a voltage potential (ground in this example). An ozone reducing catalyst 704 covers most of the insulation 216. If the ozone reducing catalyst does not conduct electricity, then the ozone reducing catalyst 704 may contact the wire or other conductor 702 without negating the advantages provided by insulating the underlying driver electrodes 214. However, if the ozone reducing catalyst 704 is electrically conductive, then care must be taken so that the electrically conductive ozone reducing catalyst 704 (covering the insulation 216) does not touch the wire or other conductor 702 that connects the underlying electrically conductive electrode 214 to a voltage potential (e.g., ground, a positive voltage, or a negative voltage). So long as an electrically conductive ozone reducing catalyst does not touch the wire 704 that connects the driver electrode 214 to a voltage potential, then the potential of the electrically conductive ozone reducing catalyst will remain floating, thereby still allowing an increased voltage potential between insulated driver electrode 206 and adjacent collector electrodes 204. Other examples of electrically conductive ozone reducing catalyst include, but are not limited to, noble metals.

In accordance with another embodiment of the present invention, if the ozone reducing catalyst is not electrically conductive, then the ozone reducing catalyst can be included in, or used as, the insulation 216. Preferably the ozone reducing catalysts should have a dielectric strength of at least 1000 V/mil (one-hundredth of an inch) in this embodiment.

If an ozone reducing catalyst is electrically conductive, the collector electrodes 204 can be coated with the catalyst. However, it is preferable to coat the insulated driver electrodes 206 with an ozone reducing catalyst, rather than the collector electrodes 204. This is because as particles collect on the collector electrodes 204, the surfaces of the collector electrodes 204 become covered with the particles, thereby reducing the effectiveness of the ozone reducing catalyst. The insulated driver electrodes 206, on the other hand, do not collect particles. Thus, the ozone reducing effectiveness of a catalyst coating the insulated driver electrodes 206 will not diminish due to being covered by particles.

Figure 8:
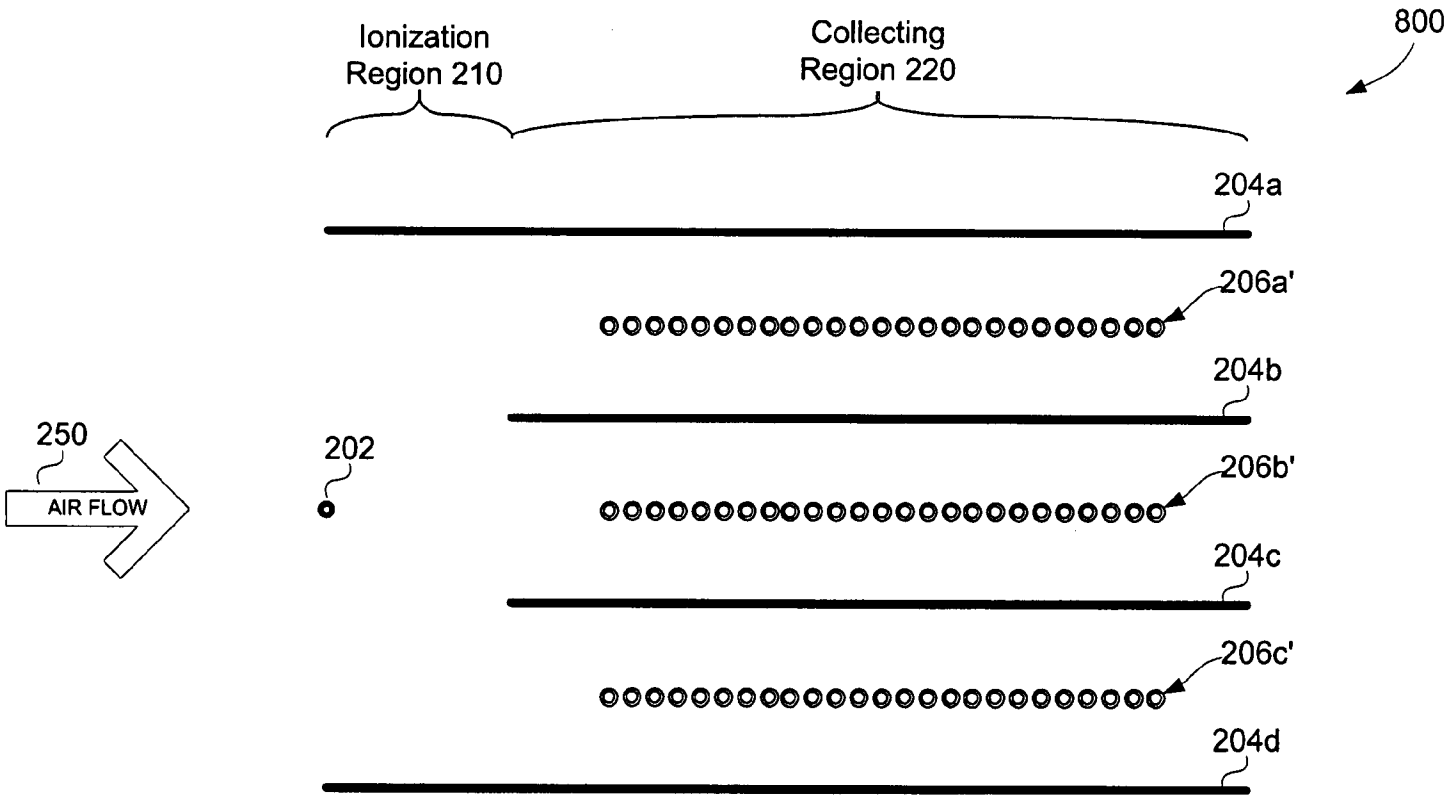
FIG. 8 illustrates schematically, an ESP device that includes insulated driver electrodes that are made from rows of insulated wire-shaped electrodes, in accordance with an alternative embodiment of the present invention.

In the previous FIGS., the insulated driver electrodes 206 have been shown as including a generally plate like electrically conductive electrode 214 covered by a dielectric insulator 216. In alternative embodiments of the present invention, the insulated driver electrodes can take other forms. For example, referring to FIG. 8, the driver electrodes can include a wire or rod-like (collectively referred to as wire-shaped) electrical conductor covered by dielectric insulation. Although a single wire-shaped insulated driver electrode can be used, it is preferable to use a row of such wire-shaped insulated electrodes to form insulated drivers electrodes, shown as 206*a*', 206*b*' and 206*c*' in FIG. 8. The electric field between such insulated driver electrodes 206' and the collector electrodes 204 will look similar to the corresponding electric fields shown in FIG. 6.

Tests have been performed that show the increased particle collecting efficiency that can be achieved using insulated driver electrodes 206. In these tests, forced air circulation (specifically, a fan) was used to produce an airflow velocity of 500 feet per minute (fpm). This is above the recommended air velocity for a conventional ESP system, since this high a velocity can cause dust particles collected on the collector electrodes to become dislodged and reintroduced into the air stream. Additionally, higher air velocities typically lower collecting efficiency since it is harder to capture fast moving particles (e.g., due to more kinetic force to overcome, and less time to capture the particles). Conventional commercially available ESP systems more likely utilize air velocities between 75 fpm and 390 fpm, depending on model and the selected air speed (e.g., low, medium or high). The higher than normal airflow velocity was intentionally used in these tests to reduce overall efficiency, and thereby make it easier to see trends in the test results.

Figure 1B:
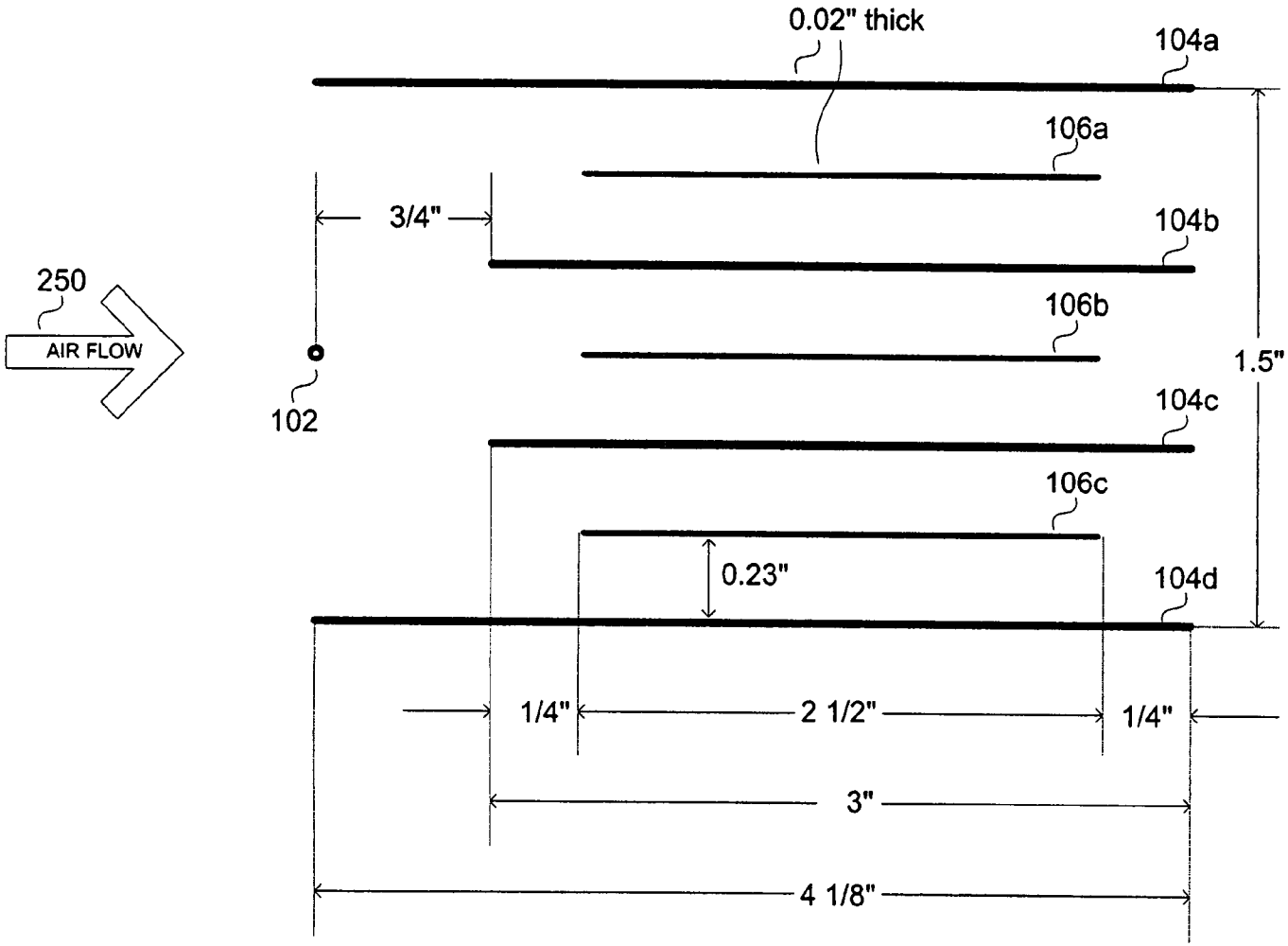
FIG. 1B PRIOR ART
FIG. 1B illustrates exemplary dimensions for the ESP system of FIG. 1A.

The system used in the tests resembled the system 200 shown in FIGS. 2A, having the dimensions shown in FIG. 2B. Tests were also performed using the conventional system 100 shown in FIG. 1A, having the dimensions shown in FIG. 1B. In these tests, the depth of the electrodes (e.g., in the Z direction, into the page) was about 5". With system 100, breakdown (i.e., arcing) between the collector electrodes 104 and un-insulated driver electrodes 106 occurred when the electric field in the collecting region 120 exceeded 1.2 kV/mm. With an electric field of 1.2 kV/mm in the collecting region 120, the collecting efficiency of 0.3 μm particles was below 0.93.

Figure 9A:
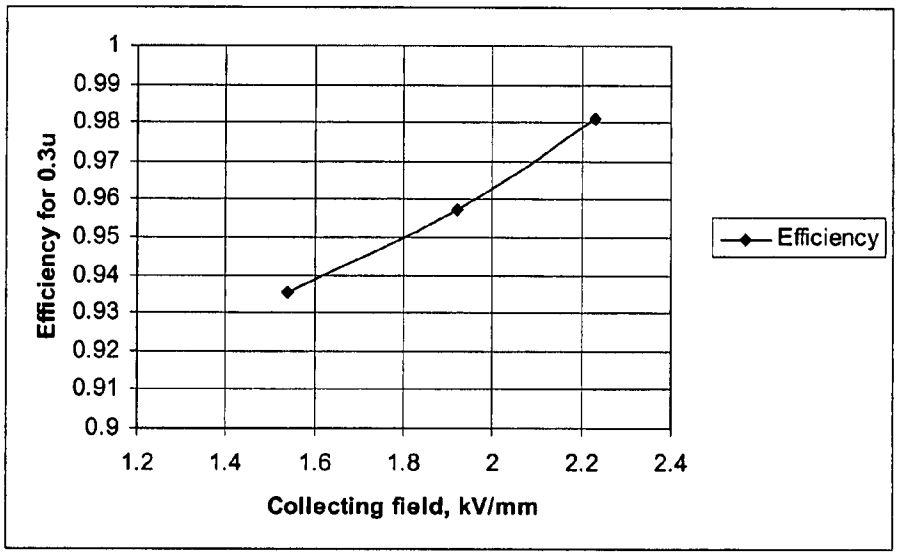
FIGS. 9A and 9B are graphs that show collection efficiency increase in relation to the collection region electric field increase.
Figure 9B:
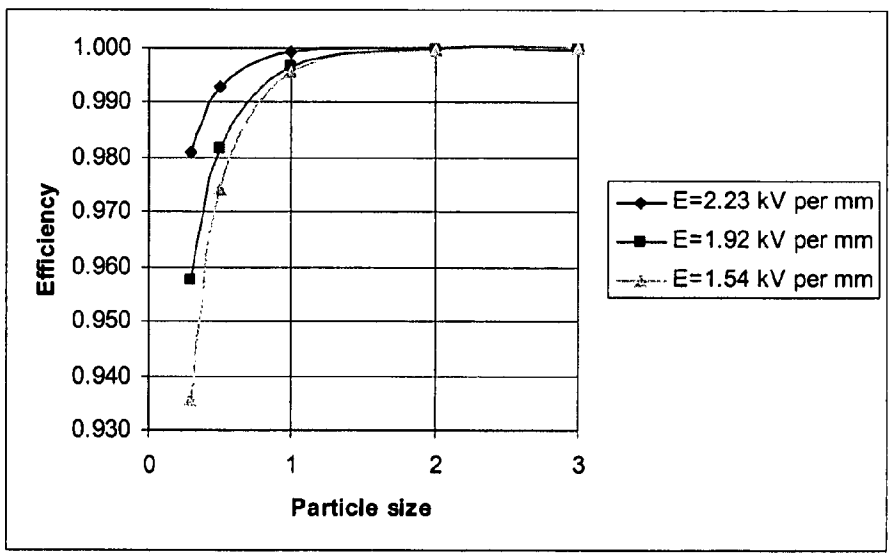

By using insulated driver electrodes 206, the electric field in the collating region 220 was able to be increased to about 2.4 kV/mm without breakdown (i.e., arcing) between the collector electrodes 204 and insulated driver electrodes 206. The graph of FIG. 9A shows collecting efficiency (for 0.3 μm particles) versus the collecting region electric field (in KV/mm) for system 200. As can be seen in FIG. 9A, the collecting efficiency increased in a generally linear fashion as the electric field in the collecting region 220 was increased (by increasing the high voltage potential difference between the collector electrodes 204 and insulated driver electrodes 206). More specifically, for 0.3 μm particles, the collecting efficiency was able to be increased to more than 0.98. The graph of FIG. 9B shows that collecting efficiency is generally greater for larger particles. FIG. 9B also shows that even for larger particles, collecting efficiency increases with an increased electric field in the collecting region 220.

As shown by the above described test results, insulated driver electrodes 206 can be used to increase collecting efficiency by enabling the electric field in a collecting region 220 to be increased beyond what has been possible without insulated driver electrodes 206. The resultant increase in electrical field between the driver electrodes 206 and collector electrodes 204, exceeds those associated with or found in conventional ESP systems and correspondingly results in increased collection efficiency where all other factors are held constant, (e.g. air speed, particle size, etc.). Thus, for an ESP system of given dimensions, the use of insulated driver electrodes 206 may significantly increase particle collection efficiency.

Insulated driver electrodes 206 can alternatively be used to reduce the length of collecting electrodes 204, while maintaining an acceptable efficiency. For example, assume that for a particular application an acceptable particle collection efficiency for 0.3 μm particles is about 0.93. By using insulated driver electrodes 206 (as opposed to non-insulated driver electrode 106), the electric field in the collection region can be increased from 1.2 kV/mm to 2.4 kV/mm, which allows collecting electrodes (and driver electrodes) to be made 3 times shorter while maintaining the efficiency that would be achieved using the 1.2 kV/mm electric field. This is possible, in part, because the particle migration velocity increases as the electric field increases.

The relationship between voltage potential difference, distance and electric field is as follows: E=V/d, where E is electric field, Vis voltage potential difference, and d is distance. Thus, the electric field within the collecting region 220 can be increased (e.g., from 1.2 kV/mm to 2.4 kV/mm) by doubling the potential difference between the collector electrodes 204 and insulated driver electrodes 206. Alternatively the electric field can be doubled by decreasing (i.e., halving) the distance between the collectors 204 and insulated driver 206. A combination of adjusting the voltage potential difference and adjusting the distance is also practical.

Figure 10:
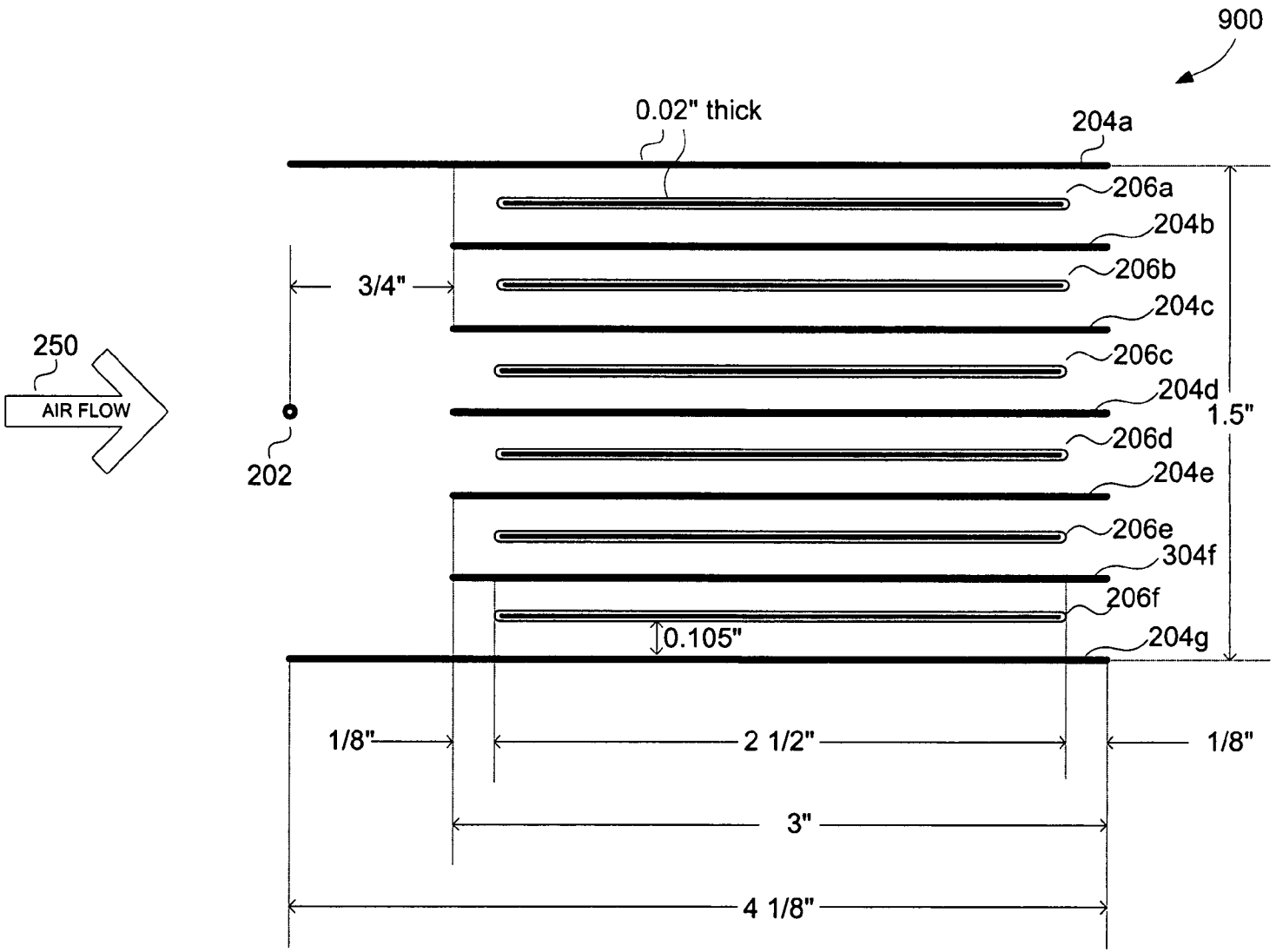
FIG. 10 illustrates schematically, an ESP device in which the collection electric field is increased by moving the electrodes in the collection region closer to one another, in accordance with an embodiment of the present invention.

Another advantage of reducing the distance between collector electrodes 204 and insulated driver electrodes 206 is that more collector electrodes can be fit within given dimensions. An increased number of collector electrodes increases the total collecting surface area, which results in increased collecting efficiency. For example, FIG. 10 shows how the number of collector electrodes could be doubled while keeping the same overall dimensions as the ESP systems in FIGS. 1B and 2B.

Embodiments of the present invention relate to the use of insulated driver electrodes in ESP systems. The precise arrangement of the corona discharge electrode 202, the collector electrodes 204 and the insulated driver electrodes 206 shown in the FIGS. discussed above are exemplary. Other electrode arrangements would also benefit from using insulated driver electrodes. For example, in most of the above discussed FIGS., the ESP systems include one corona discharge electrode 102, four collector electrodes 204 and three insulated driver electrodes 206. In FIG. 10, the number of collector electrodes 204 was increased to seven, and the number of insulated driver electrodes 206 was increased to six. These are just exemplary configurations. Preferably there are at least two collector electrodes 204 for each corona discharge electrode 202, and there is an insulated driver electrode 206 preferably located between each adjacent pair of collector electrodes 204, as shown in the FIGS. The collector electrodes 204 and insulated driver electrodes 206 preferably extend in a downstream direction from the corona discharge electrode 202, so that the collecting region 220 is downstream from the ionization region 210.

Figure 11:
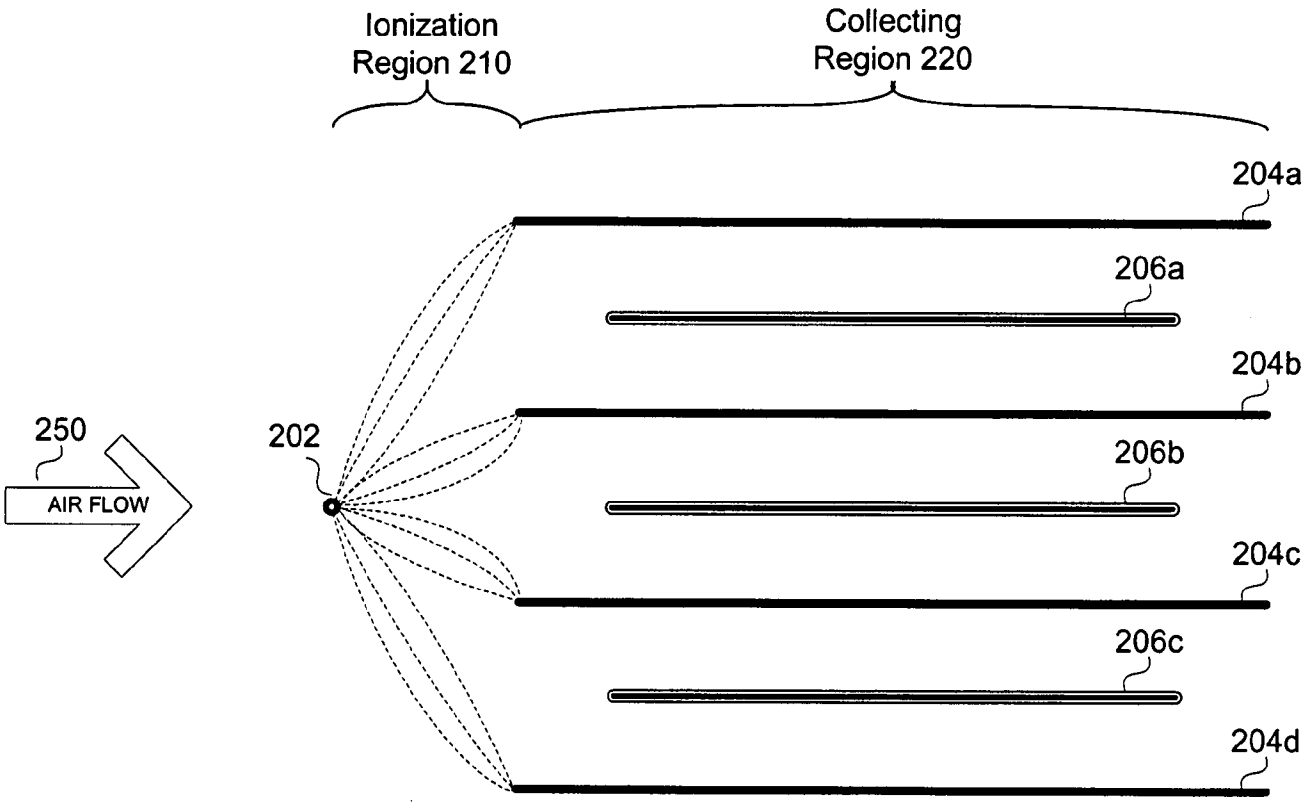
FIG. 11 illustrates schematically, further exemplary electric field lines that may be produced between a corona discharge electrode and collector electrodes.

In the above discussed FIGS. the outermost collector electrodes (e.g., 204*a* and 204*d* in FIG. 2A) are shown as extending further upstream then the innermost collector electrodes (e.g., 204*b* and 204*c* in FIG. 2B). This arrangement is useful to creating an ionization electric field, within the ionization region 210, that charges particles within the airflow 250. However, such an arrangement is not necessary. For example, as mentioned above in the discussion of FIG. 6, and as shown by dashed lines in FIG. 11, an ionization electric field can also be created between the corona discharge electrode 202 and the upstream ends of the collectors electrodes 204, if they are sufficiently close to the corona discharge electrode 202.

Figure 12:
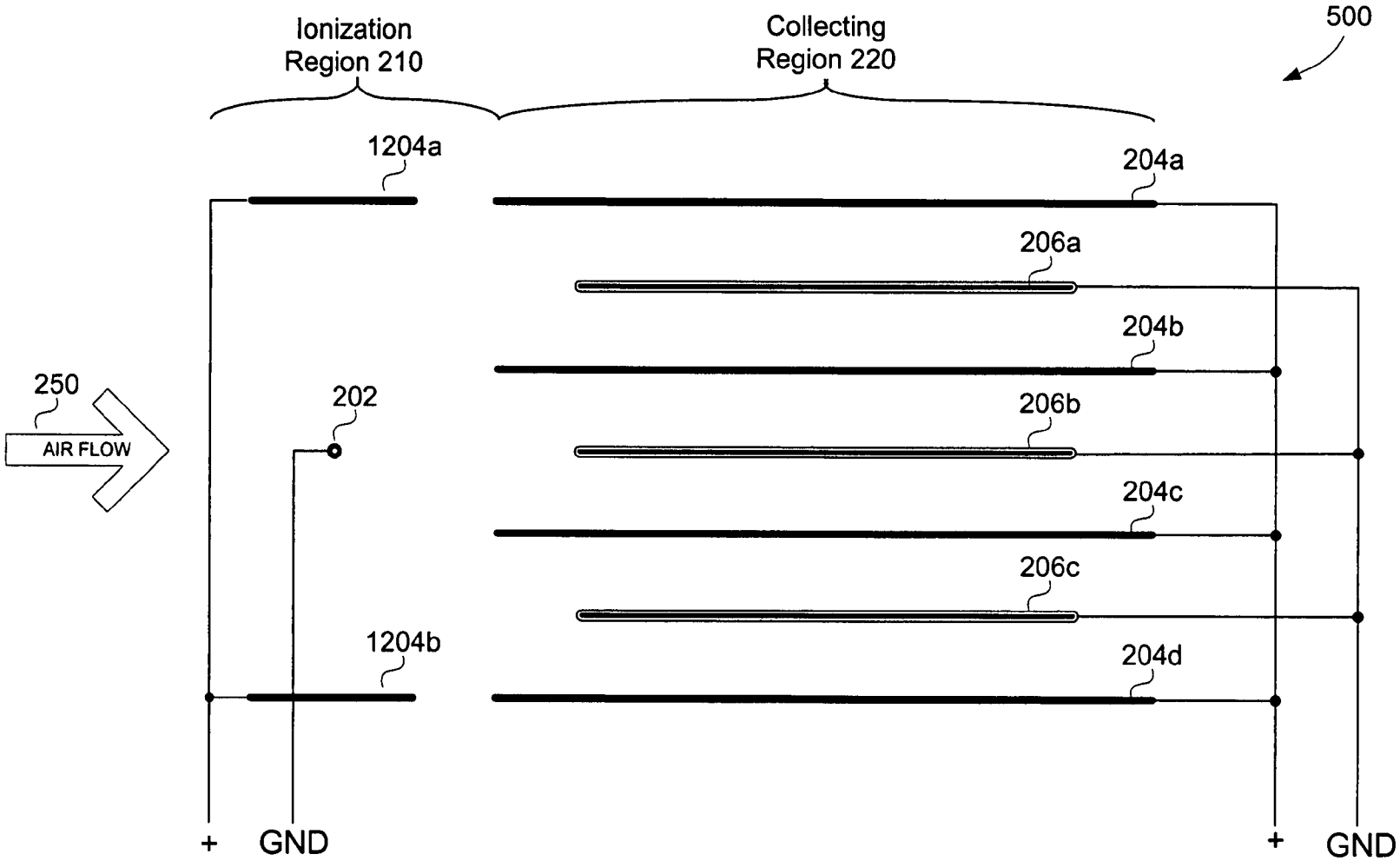
FIG. 12 illustrates schematically, an alternative electrode configuration, in accordance with an embodiment of the present invention, where the ionization region includes its own collector type electrodes.

As shown in FIG. 12, it is also possible that the ionization region 210 includes separate collecting electrodes 1204 to produce the ionization electric field.

Figure 13:
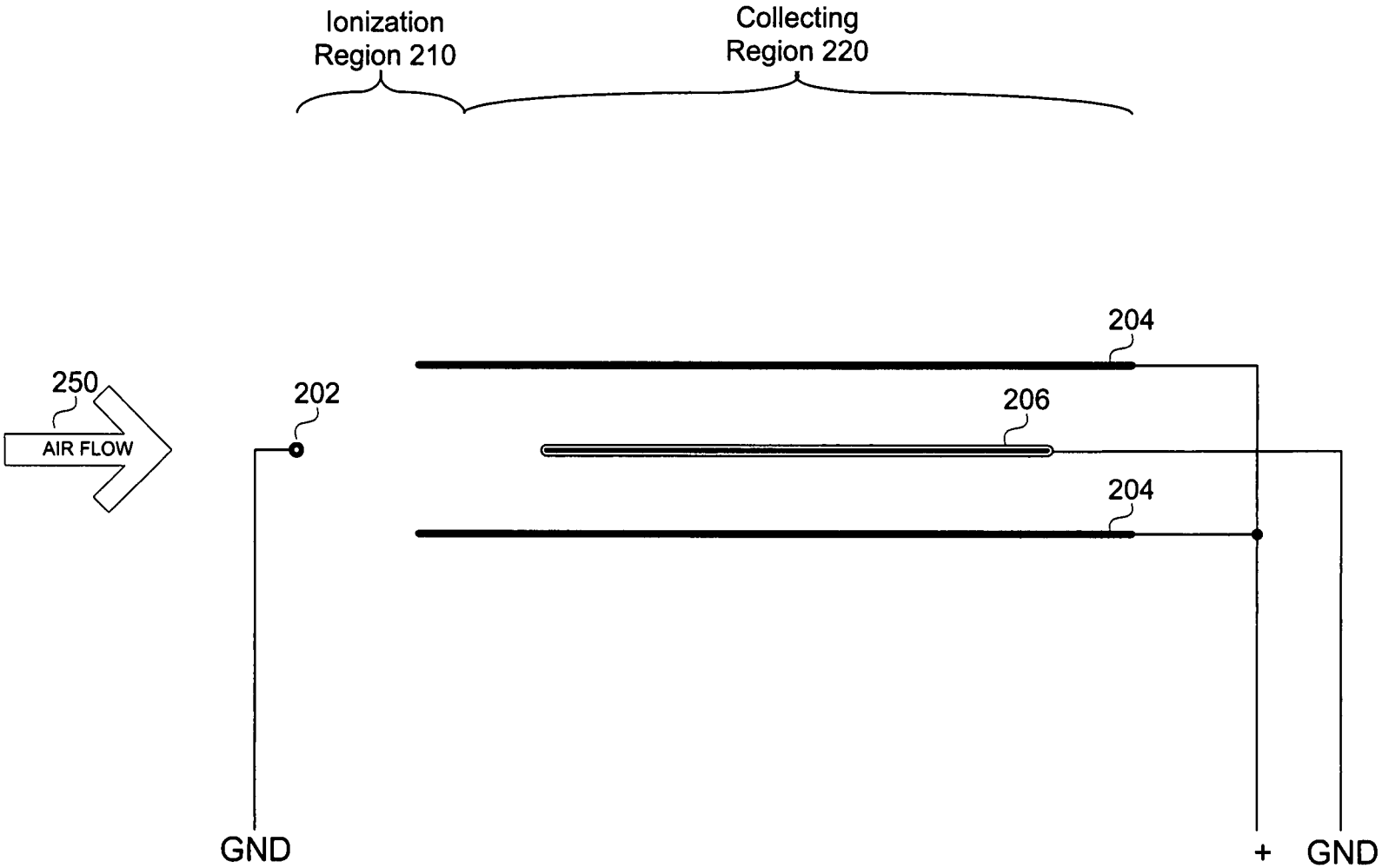
FIG. 13 illustrates schematically, an ESP system, according to another embodiment of the present invention.

FIG. 13 shows an exemplary embodiment of the present invention that includes a single corona discharge electrode 202, a pair of collector electrodes 204, and a single insulated driver electrode 206. Other numbers of corona discharge electrodes 202, collector electrodes 204, and insulated driver electrodes are also within the spirit and scope of the present. For example, there can be multiple corona discharge electrodes 202 in the ionization region.

In the various electrode arrangements described herein, the corona discharge electrode 202 can be fabricated, for example, from tungsten. Tungsten is sufficiently robust in order to withstand cleaning, has a high melting point to retard breakdown due to ionization, and has a rough exterior surface that seems to promote efficient ionization. A corona discharge electrode 202 is likely wire-shaped, and is likely manufactured from a wire or, if thicker than a typical wire, still has the general appearance of a wire or rod. Alternatively, as is known in the art, other types of ionizers, such as pin or needle shaped electrodes can be used in place of a wire. For example, an elongated saw-toothed edge can be used, with each edge functioning as a corona discharge point. A column of tapered pins or needles would function similarly. As another alternative, a plate with a sharp downstream edge can be used as a corona discharge electrode. These are just a few examples of the corona discharge electrodes that can be used with embodiments of the present invention. Further, other materials besides tungsten can be used to produce the corona discharge electrode 202.

In accordance with an embodiment of the present invention, collector electrodes 204 have a highly polished exterior surface to minimize unwanted point-to-point radiation. As such, collector electrodes 204 can be fabricated, for example, from stainless steel and/or brass, among other materials. The polished surface of collector electrodes 204 also promotes ease of electrode cleaning. The collector electrodes 204 are preferably lightweight, easy to fabricate, and lend themselves to mass production. The collector electrodes can be solid. Alternatively, the collector electrodes may be manufactured from sheet metal that is configured to define side regions and a bulbous nose region, forming a hollow elongated shaped or "U"-shaped electrode. When a U-shaped electrode, the collector will have a nose (i.e., rounded end) and two trailing sides (which may be bent back to meet each other, thereby forming another nose). Similarly, in embodiments including plate like insulated driver electrodes 206, the underlying driver electrodes can be made of a similar material and in a similar shape (e.g., hollow elongated shape or "U" shaped) as the collector electrodes 204.

Figure 14:
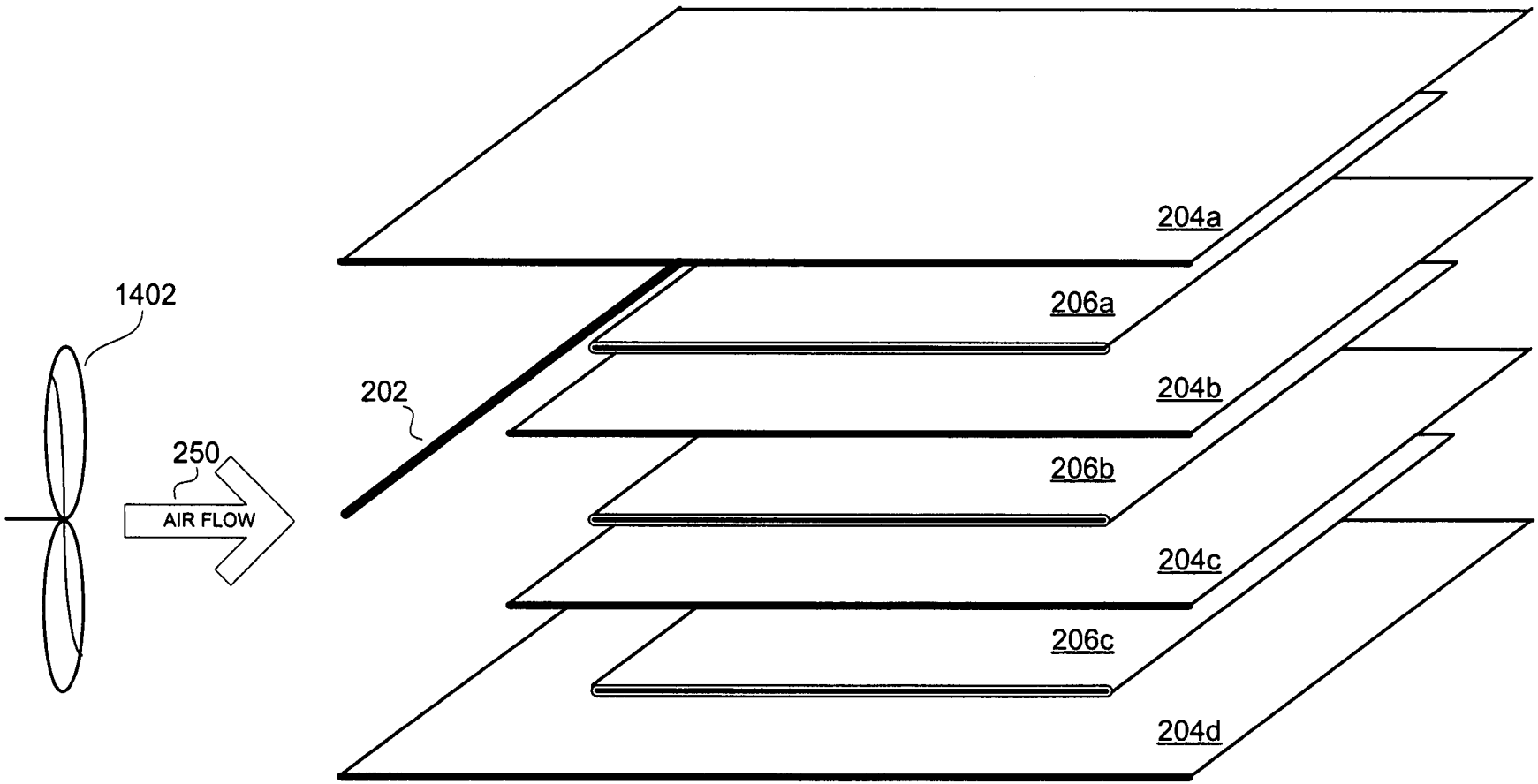
FIG. 14 is a perspective view of an ESP system that includes generally horizontal electrodes, in accordance with an embodiment of the present invention.
Figure 15:
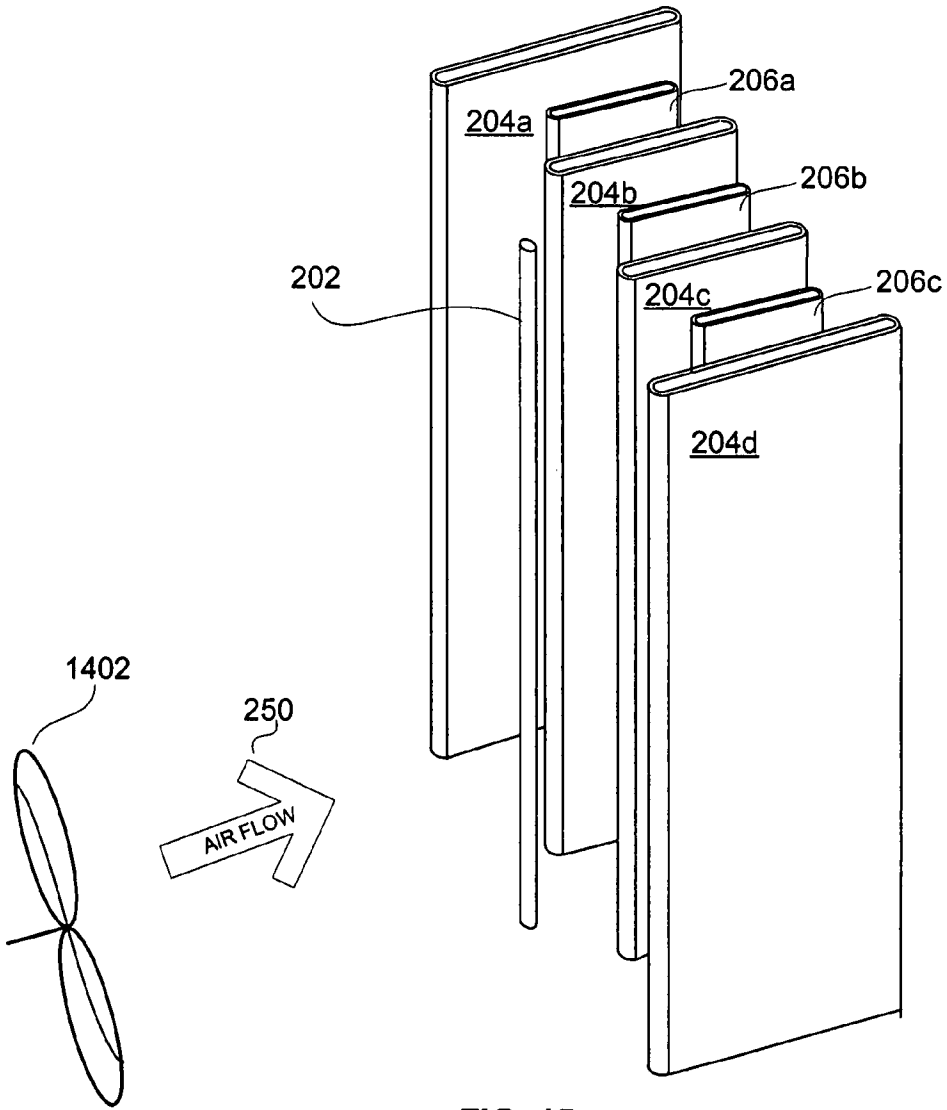
FIG. 15 is a perspective view of an ESP system that includes generally vertical electrodes, in accordance with an embodiment of the present invention.

The corona discharge electrode(s) 202, collector electrodes 204 and insulated driver electrode(s) 206 may be generally horizontal, as shown in FIG. 14. Alternatively, the corona discharge electrode(s) 202, collector electrodes 204 and insulated driver electrode(s) 206 may be generally vertical, as shown in FIG. 15. Of course, it is also possible that the electrodes are neither vertical nor horizontal (i.e., they can be slanted or diagonal). Preferably the various electrodes are generally parallel to one another so that the electric field strength is generally evenly distributed.

The corona discharge electrode(s) 202, the collector electrodes 204 and the insulated driver electrode(s) 206, collectively referred to as an ESP electrode assembly, can be located within a freestanding housing that is meant to be placed within a room, to clean the air within the room. Depending on whether the electrode assembly is horizontally arranged (e.g., as in FIG. 13) or vertically arranged (e.g., as in FIG. 14), the housing may be more elongated in the horizontal direction or in the vertical direction. It is possible to rely on ambient air pressure to channel air through the unit, such as that found in a room where very little current exists and the air pressure remains relatively constant or on cyclical air pressure, such as that created by a breeze or natural air movement such as through a window. Alternatively it may be desirable to use forced air circulation to process a larger amount of air. If forced air circulation is to be used, the housing will likely include a fan that is upstream of the electrode assembly. An upstream fan 1402 is shown in FIGS. 14 and 15. If a fan that pulls air is used (as opposed to a fan that pushes air), the fan may be located downstream from the electrode assembly. Within the housing there will also likely be one more high voltage sources that produce the high voltage potentials that are applied to the various electrodes, as described above. The high voltage source(s) can be used, for example, to convert a nominal 110 VAC (from a household plug) into appropriate voltage levels useful for the various embodiments of the present invention. It is also possible that the high voltage source(s) could be battery powered. High voltage sources are well known in the art and have been used with ESP systems for decades, and thus need not be described in more detail herein. Additional details of an exemplary housing, according to an embodiment of the present invention, is discussed below with reference to FIG. 17.

The use of an insulated driver electrode, in accordance with embodiments of the present invention, would also be useful in ESP systems that are installed in heating, air conditioning and ventilation ducts.

In most of the FIGS. discussed above, four collector electrodes 204 and three insulated driver electrodes 206 were shown, with one corona discharge electrode 202. As mentioned above, these numbers of electrodes have been shown for example, and can be changed. Preferably there is at least a pair of collector electrodes with an insulated driver electrode therebetween to push charged particles toward the collector electrodes. However, it is possible to have embodiments with only one collector electrode 204, and one or more corona discharge electrodes 202. In such embodiments, the insulated driver electrode 206 should be generally parallel to the collector electrode 204. Further, it is within the spirit and scope of the invention that the corona discharge electrode 202 and collector electrodes 204, as well as the insulated driver electrodes 206, can have other shapes besides those specifically mentioned herein.

A partial discharge may occur between a collecting electrode 204 and an insulated driver electrode 206 if dust or carbon buildup occurs between the collecting electrode 204 and the insulated driver electrode 206. More specifically, it is possible that the electric field in the vicinity of such buildup may exceed the critical or threshold value for voltage breakdown of air (which is about 3 kV/mm), causing ions from the collecting electrode 204 to move to the insulated driver 206 and get deposited on the insulation 216. Thus, the electric field gets redistributed in that the field becomes higher inside the insulation 216 and lower in the air until the field gets lower than the threshold value causing voltage breakdown. During the partial discharge, only the small local area where breakdown happens has some charge movement and redistribution. The rest of the ESP system will work normally because the partial discharge does not reduce the voltage potential difference between the collector electrode 204 and the underlying electrically conductive portion 214 of the insulated driver electrode 206.

Figure 16:
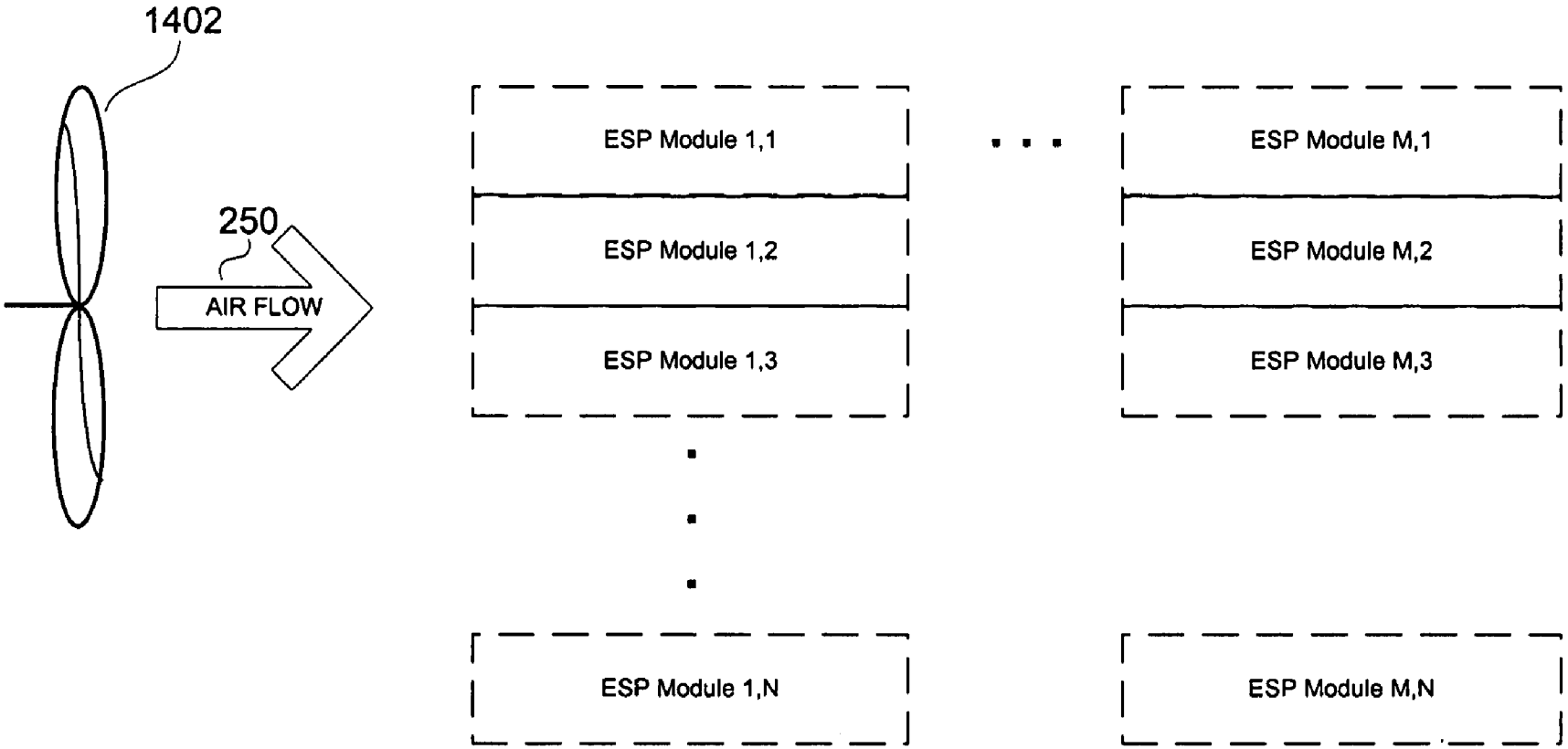
FIG. 16 shows how multiple ESP systems of the present invention can be combined to create a larger ESP system.

As shown in FIG. 16, many of the ESP modules or systems of the present invention, described above, can be combined to produce larger ESP systems that include multiple sub-ESP modules. For example, multiple (e.g., N) ESP modules (e.g., 200, 300, 400, 500 etc.) can be located one next to another, and/or one above another, to produce a physically larger ESP system that accepts a greater airflow area. Additionally (or alternatively), one or more ESP modules (e.g., M) can be located downstream from one another in a serial fashion. The one or more downstream ESP modules will likely capture any particles that escape through the upstream ESP module(s). In accordance with embodiments of the present invention, multiple ESP modules are housed within a common housing, with the multiple ESP modules (or portions of the ESP modules) collectively removable for cleaning.

Collector electrodes 204 should be cleaned on a regular basis so that particles collected on the electrodes are not reintroduced into the air. It would also be beneficial to clean the corona discharge electrodes 202, as well as the insulated driver electrodes 206 from time to time. Cleaning of the electrodes can be accomplished by removing the electrodes from the housing within which they are normally located. For example, as disclosed in the application and patent that were incorporated by reference above, a user-liftable handle can be affixed the collector electrodes 204, which normally rest within a housing. Such a handle member can be used to lift the collectors 204 upward, causing the collector electrodes 204 to telescope out of the top of the housing and, if desired, out of the housing. In other embodiments, the electrodes may be removable out of a side or bottom of the housing, rather than out the top. The corona discharge electrode(s) 202 and insulated driver electrodes 206 may remain within the housing when the collectors 204 are removed, or may also be removable. The entire electrode assembly may be collectively removable, or each separate type of electrodes may be separately removable. Once removed, the electrodes can be cleaning, for example, using a damp cloth, by running the electrodes under water, or by putting the electrodes in a dish washer. The electrodes should be fully dry before being returned to the housing for operation.

Figure 17:
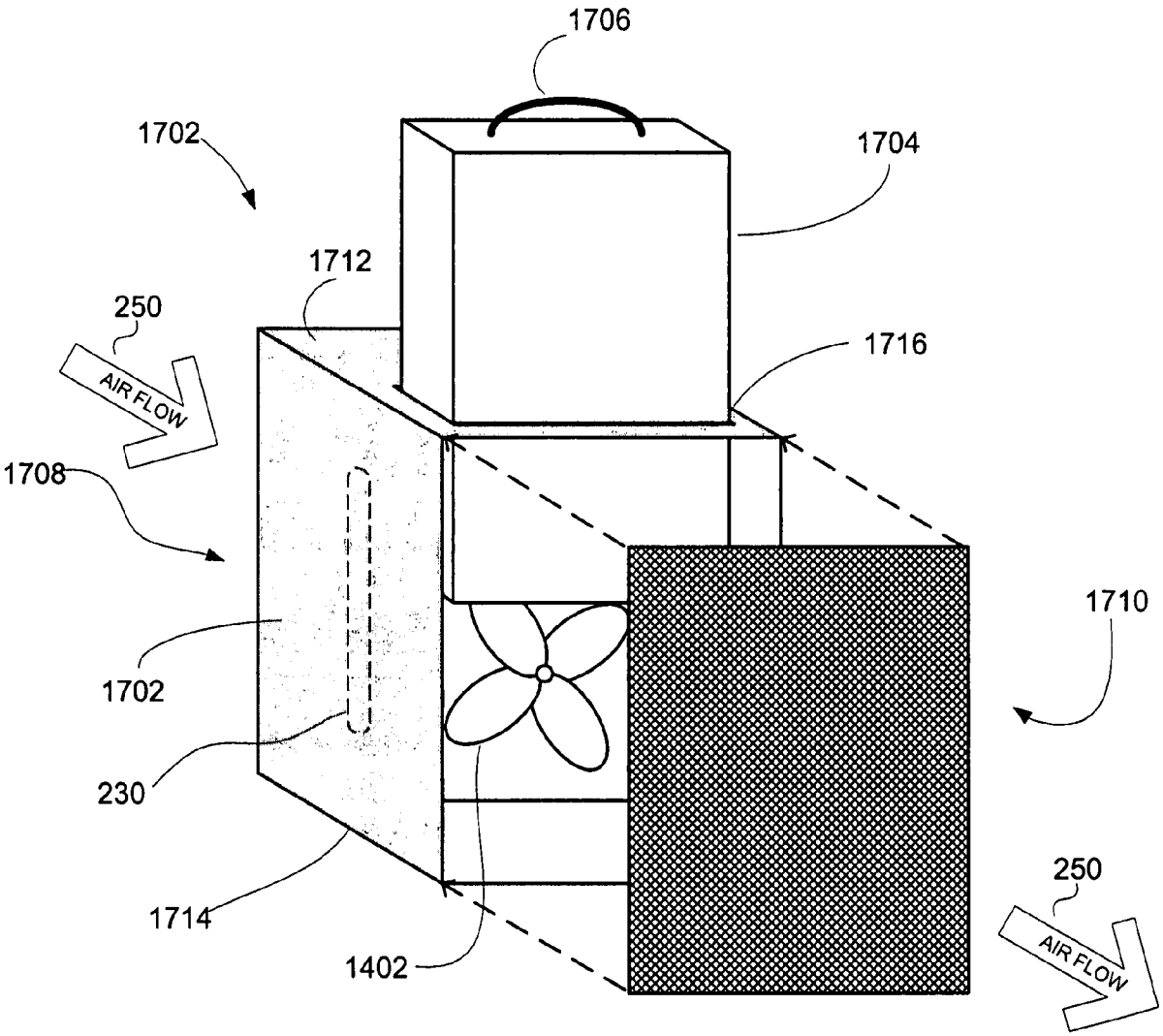
FIG. 17 is a perspective view of an exemplary housing for an ESP system, according to an embodiment of the present invention.

FIG. 17 illustrates an exemplary housing 1702 that includes a back 1708, a front 1710, a top 1712 and a bottom or base 1714. The top 1712 includes an opening 1716 through which an electrode assembly 1706 (or portion thereof) can be removed. A handle 1706 can be used to assist with removal of the electrode assembly 1704. The opening 1716 can alternatively be on a side, or through the bottom 1714, so that the assembly 1704 can be removed out a side, or out the bottom 1714.

The removable electrode assembly 1704 can include one or more ESP modules (sometimes also referred to as cells), as was described above with reference to FIG. 16, with each ESP module including one or more corona discharge electrode 202, collector electrode 204 and insulated driver electrode 206. Alternatively, the removable portion of the electrode assembly 1704 can include only collector electrode(s) 204, or collector electrode(s) 204 and insulated driver electrode(s) 206, with the corona discharge electrode (s) 202 (and possible insulated driver electrode(s) 206) remaining in the housing when the assembly 1704 is removed for cleaning. A fan 1402 can be used to push air, or pull air, past the electrodes of the electrode assembly 1704, as was described above. The back 1708 and front 1710 of the housing 1702 preferably allow air to flow in and out of the housing 1702, and thus will likely include one or more vents, or can include a grill. As shown in dashed line, a germicidal lamp 230 can be included within the housing, to further condition the airflow.

The housing 1702 can be an upstanding vertically elongated housing, or a more box like housing that is generally shaped like a square. Other shapes are of course possible, including but not limited to for example an elongated horizontal unit, a circular unit, a spiral unit, other geometric shapes and configurations or even a combination of any of these shapes. It is to be understood that any number of shapes and/or sizes could be utilized in the housing without departing from the spirit and scope of the present invention. The housing 1702 can also be a freestanding stand alone type housing, so that it can be placed on a surface (e.g., floor, counter, shelf, etc.) within a room. In one embodiment, the housing 1702 can be sized to fit in or on a window sill, in a similar fashion to a window unit air conditioning cooling unit. It is even possible that the housing 1702 is a small plug-in type housing that includes prongs that extend therefrom, for plugging into an electrical socket. In another embodiment, a cigarette lighter type adapter plug extends from a small housing so that the unit can be plugging into an outlet in an automobile.

In another embodiment, the housing 1702 can be fit within a ventilation duct, or near the input or output of an air heating furnace. When used in a duct, the electrode assembly 1704 may simply be placed within a duct, with the duct acting as the supporting housing for the electrode assembly 1704.

The foregoing descriptions of the preferred embodiments of the present invention have been provided for the purposes of illustration and description. It is not intended to be exhaustive or to limit the invention to the precise forms disclosed. Many modifications and variations will be apparent to the practitioner skilled in the art. Modifications and variations may be made to the disclosed embodiments without departing from the subject and spirit of the invention as defined by the following claims. Embodiments were chosen and described in order to best describe the principles of the invention and its practical application, thereby enabling others skilled in the art to understand the invention, the various embodiments and with various modifications that are suited to the particular use contemplated. It is intended that the scope of the invention be defined by the following claims and their equivalents.

What is claimed:

1. An electrostatic precipitator (ESP) system, comprising:

a corona discharge electrode;

a pair of collector electrodes;

an insulated driver electrode located between said pair of collector electrodes;

a first high voltage source coupled between said corona discharge electrode and said pair of collector electrodes, said first high voltage source configured to provide a first high voltage potential difference between said corona discharge electrode and said pair of collector electrodes; and a second high voltage source coupled between said pair of collector electrodes and said insulated driver electrode, said second high voltage source configured to provide a second high voltage potential difference between said pair of collector electrodes and said insulated driver electrode.

2. The system of claim 1, wherein said pair of collector electrodes extend in a downstream direction away from said corona discharge electrode, and wherein said system further comprises a fan to produce a flow of air in said downstream direction.

3. The ESP system of claim 2, wherein:

said corona discharge electrode produces a corona discharge that imparts a charge on particles in the air that flows past said corona discharge electrode;

said insulated driver electrode repels the charged particles toward said collector electrodes; and said collector electrodes attract and collect at least a portion of the charged particles.

4. The system of claim 1, wherein:

a first voltage potential difference exists between said corona discharge electrode and said pair of collector electrodes; and a second voltage potential difference exists between said insulated driver electrode and said pair of collector electrodes, said first and second voltage potentials differences being substantially the same.

5. The system of claim 3, wherein:

a first voltage potential difference exists between said corona discharge electrode and said pair of collector electrodes; and a second voltage potential difference exists between said insulated driver electrode and said pair of collector electrodes, said first voltage potential difference being different than said second voltage potentials difference.

6. The system of claim 1, wherein said corona discharge electrode and said insulated driver electrode are at the same voltage potential.

7. The system of claim 6, wherein said high voltage source also provides the high voltage potential difference between said collector electrodes and said insulated driver electrode.

8. The system of claim 1, wherein said corona discharge electrode and said insulated driver electrode are at different voltage potentials.

9. The system of claim 1, wherein said corona discharge electrode and said insulated driver electrode are at a same voltage potential.

10. The system of claim 1, wherein:

said corona discharge electrode is at a first voltage potential;

said pair of collector electrodes are at a second voltage potential different than said first voltage potential; and said insulated driver electrode is at a third voltage potential different than said first and second voltage potentials.

11. The system of claim 1, wherein the insulated driver electrode is coated with an ozone reducing catalyst.

12. The system of claim 1, wherein the insulated driver electrode includes an electrically conductive electrode covered by a dielectric material.

13. The system of claim 12, wherein the dielectric material is coated with an ozone reducing catalyst.

14. The system of claim 12, wherein the dielectric material comprises a non-electrically conductive ozone reducing catalyst.

15. The system of claim 12, wherein the electrically conductive electrode of the insulated driver electrode includes generally flat elongated sides that are generally parallel with said collector electrodes.

16. The system of claim 1, wherein said insulated driver electrode includes at least one wire shaped electrode covered by a dielectric material.

17. The system of claim 1, wherein the driver electrode includes a row of wire shaped electrodes each covered by a dielectric material, said row being generally parallel to said collector electrodes.

18. The system of claim 1, wherein said insulated driver electrode is located downstream from said corona discharge electrode.

* * * * *